US006033020A

United States Patent [19]

Ito

[11] Patent Number: 6,033,020

[45] Date of Patent: Mar. 7, 2000

[54] ROCKING APPARATUS

[75] Inventor: Tsunetaro Ito, Ina, Japan

[73] Assignee: Takano Co., Ltd., Nagano, Japan

[21] Appl. No.: 09/149,823

[22] Filed: Sep. 8, 1998

[30] Foreign Application Priority Data

Sep. 10, 1997 [JP] Japan ..... 9-245834
Mar. 30, 1998 [JP] Japan ..... 10-084674

[51] Int. Cl.[7] ..... A47C 1/024

[52] U.S. Cl. ..... 297/302.4; 297/302.7; 297/328

[58] Field of Search ..... 297/270.1, 270.4, 297/301.6, 301.7, 302.1, 302.2, 302.3, 302.4, 303.5, 302.6, 302.7, 328

[56] References Cited

U.S. PATENT DOCUMENTS

| | | | |
|---|---|---|---|
| 3,434,756 | 3/1969 | Walkinshaw | 297/301.7 X |
| 4,832,402 | 5/1989 | Zünd | 297/302.4 X |
| 4,858,993 | 8/1989 | Steinmann | 297/302.4 X |
| 4,889,384 | 12/1989 | Sulzer | 297/302.4 X |
| 4,892,354 | 1/1990 | Esthowski et al. | 297/302.3 X |
| 4,948,198 | 8/1990 | Crossman et al. | 297/302.4 X |
| 5,207,479 | 5/1993 | Wickman et al. | 297/302.4 X |

FOREIGN PATENT DOCUMENTS

| | | |
|---|---|---|
| 56-45483 | 10/1981 | Japan . |
| 58-19660 | 2/1983 | Japan . |
| 58-159954 | 10/1983 | Japan . |
| 59-103674 | 7/1984 | Japan . |
| 511796 | 10/1988 | Japan . |
| 127719 | 8/1989 | Japan . |
| 446601 | 12/1989 | Japan . |

*Primary Examiner*—Peter R. Brown
*Attorney, Agent, or Firm*—Notaro & Michalos P.C.

[57] ABSTRACT

A rocking apparatus has a supported member and a supporting member. The supported member rotatably supported on the supporting member at two distant points on a rotary shaft. The rotary shaft is provided with a reaction force imparting member, which is constantly pushed toward its initial position by a reaction force imparting mechanism, so as to be capable of oscillation. A strut is provided between the reaction force imparting member and the supported member, and the supported member is supported on the reaction force imparting member and the rotary shaft by the three-point support using the connecting members and the strut. Further, a lock mechanism consisting of the locked member having engagement grooves, the lock member fitted in or removed from the engagement groove and a impetus giving member to transmit movement of the operating means to the lock member and elastically give an impetus at least in the direction for removing the lock member from the engagement groove is provided between the supported member and the supporting member, friction between the lock member and the locked member is used to prevent the lock member from coming off when the lock member is tried to be removed from the engagement groove and no load is being applied on the supported member, and the locked state is cancelled by using accumulated spring force to remove the lock member from the engagement groove at the same time when a load is applied on the supported member.

14 Claims, 18 Drawing Sheets

ROCKING APPARATUS

BACKGROUND OF THE INVENTION AND RELATED ART STATEMENT

The present invention relates to a rocking apparatus for attaching a given member to another member in such a manner that the given member can rock. More particularly, the present invention relates to improvement of a rocking apparatus for supporting a first supported member on a second supporting member so as to be capable of oscillation in such a manner that a seat is attached to a leg portion in a chair so that the seat can tilt for example, and a self-holding mechanism of a locking mechanism for locking the supported member at an arbitrary position or inclination in connection with the rocking apparatus.

An example of a rocking apparatus for supporting a first supported member with respect to a second supporting member in such manner that the supported member can rock, is a chair such as shown in FIGS. 19 and 20. The rocking apparatus 201 is provided with: a seat bearing member 203 supported on a leg 202; a supporting shaft 204 rotatably attached to the front side of the seat bearing member 203 with its longitudinal direction corresponding to the width direction of the chair; brackets 206, 206 fixed at both ends of the supporting shaft 204 in order to support a seat 205; a rocking plate 207 fixed at the central portion of the supporting shaft 204; a reaction force imparting mechanism 208 formed of a helical compression spring for upwardly pushing the rocking plate 207; and a lock mechanism (not shown) for fixing the seat 205 and a backrest 209 with an arbitrary inclination. Here, there can be adopted as the lock mechanism various kinds of mechanisms such that a gas spring is provided between the seat bearing member 203 and the bracket 206, a shaft member pierces through the bracket 206 and the seat bearing member 203 so that they can be fixed, a lock member of the seat bearing member 203 is engaged with a gear member fixed to the bracket 206 for fixing, or a plurality of clutch plates are fixed and superimposed respectively on the bracket 206 and the seat bearing member 203 so that they can be fixed by fastening the respective clutch plates. In this chair, the seat 205 and the backrest 209 can rock by unlocking the lock mechanism. On the other hand, the seat 205 and the backrest 209 can be locked at a desired angle by locking the lock mechanism.

Further, as shown in FIG. 21, there is another rocking apparatus in which a torsion bar 110 is adopted as a reaction force imparting mechanism. In case of this rocking apparatus 101, a central portion of the torsion bar 110 is fixed to the seat bearing member 103 attached to the leg 102 while the brackets 106, 106 are fixed to the both ends of the torsion bar 110 and, when a user applies his/her weight on a backrest integrated with the seat, the seat tilts backwards the brackets 106, 106 twisting the torsion bar 110. As a result, the seat and the backrest tilt backwards while receiving the reaction force of the torsion bar 110 when the load is applied in the rear direction, and they are returned to their original positions by the torsion bar 110 when this load is no longer applied, thereby performing the rocking operation.

In each rocking apparatus described above, however, the seat is supported on only the brackets provided on the both sides, which requires large brackets that are long in the front-and-back direction. This results in deterioration in the appearance of the chair and in restriction in design. In addition, since the large brackets are necessary, a decrease in a number of parts is difficult and assembling work of the chair is complicated, thereby making it hard to reduce the manufacturing cost.

There is still another chair having a rocking apparatus provided with a lock mechanism with which the seat and the backrest can be fixed at a given angle. For example, the rocking apparatus 101 shown in FIG. 22 includes: a front seat frame 104 fixed to the leg 106; a rear seat frame 102 which can rock with respect to the leg 106; the reaction force imparting mechanism (not shown) for imparting a force for returning the rear seat frame 102 to its original position; and the lock mechanism 107 formed of a gas spring which can lock with the rear seat frame 102 being inclined (see Japanese patent laid-open publication No. Hei 4-193108). In this chair, the seat 103 and the backrest 105 can rock by setting the lock mechanism 107 to the unlocking mode. On the other hand, when the lock mechanism 107 enters the locking mode, the seat 103 and the backrest 105 can be locked while maintaining their inclination.

In this rocking apparatus, however, when the lock mechanism is switched to the unlocking mode, the locked state of the seat and the backrest is immediately canceled so that they can be rocked. Accordingly, when the lock mechanism is set in the locking mode with the seat and the backrest being inclined and no one is sitting in the chair, the reaction force caused by the reaction force imparting mechanism may suddenly spring up the seat and the backrest by switching the lock mechanism from the locking mode to the unlocking mode.

OBJECT AND SUMMARY OF THE INVENTION

It is, therefore, an object of the present invention to provide a rocking apparatus which requires no large bracket when fixing the rocking apparatus to the seat. It is another object of the present invention to provide a rocking apparatus which can prevent the reaction force of a reaction force imparting mechanism from suddenly springing up a supported member when switching to the unlocking mode.

To achieve this aim, the present invention provides a rocking apparatus for supporting a first supported member on a second supporting member in such a manner that the supported member can rock around one swivel shaft and for pushing the supported member by a reaction force imparting mechanism toward its initial position, the rocking apparatus comprising: connecting members for connecting the swivel shaft and the first supported member at two distant points on the swivel shaft so that the supported member can be rotatably supported on the second supporting member; a reaction force member supported by the swivel shaft for always being pushed by the reaction force imparting mechanism toward its original position; and a strut which is provided between the reaction force member and the first supported member, at the apex of a triangle and connected to either the reaction force member or the supported member to support the supported member by the reaction force member, connecting members at the two distant points of the swivel shaft defining the other two apices of the triangle, thereby supporting the supported member on the reaction force member and the swivel shaft by a three-point support of the connecting members and the strut.

Therefore, since the first supported member is supported by the second supporting member at three points where, two distant points on the swivel shaft, e.g., both ends of the swivel shaft and one point on the reaction force member occupy three apices of a triangle, large brackets which are long in the front-and-back direction are no longer necessary. This reduces limitations in designing a product incorporating the rocking apparatus and thereby increases the degree of freedom in design.

Here, as the connecting member, it is preferred to use a bracket having a claw portion for clamping onto the swivel shaft. In this case, the supported member can be easily attached to the swivel shaft by the side of the supporting member when the claw portion of the bracket which is the connecting member is put on and fitted on the swivel shaft. After the claw portion of the bracket is widened by and fitted on the swivel shaft, the claw portion rotates to clamp the swivel shaft to prevent the swivel shaft from coming off.

In addition, it is preferable that the connecting member and/or the strut and the supported member are made of synthetic resin and integrally molded. In this case, elimination of the process for assembling the connecting member or the strut to the supported member can further reduce the manufacturing cost.

Moreover, the strut may be preferably fixed to the reaction force member so that the strut can be associated with the reaction force member. In this case, the movement of the supported member can be completely controlled by the reaction force imparting member to prevent only the supported member from springing up.

Further, the rocking apparatus according to the present invention comprises: a locked member or member to be locked which has a plurality of engagement grooves aligned in the rocking direction of the first supported member and is attached to either the second supporting member or the first supported member; a lock member which is either on the second supporting member or the first supported member (to which the locked member is not attached) so as to be capable of sliding in the direction to be fitted in or removed from the engagement groove and which locks inclination of the supported member when fitted in the engagement groove; an operating means which is switched between the lock position and the unlock position; a position holding means which hold the operating means at least in the unlock position; and an impetus giving or biasing means which is provided between the operating means and the lock member to transmit movement of the operating means to the lock member and elastically gives an impetus at least in the direction for removing the lock member from the engagement groove.

In this case, when the operating means is in the lock position and the lock member is fitted in the engagement groove of the member to be locked, the lock member stretches over the supporting member or the supported member to which the lock member is attached and the engagement groove, and hence tilt of the supported member is locked. In this state, if no external force or very small external force acts on the supported member, the supported member receives the large reaction force of the reaction force imparting mechanism and is pushed to return to its initial position. Here, since the interior wall of the engagement groove of the locked member and the lock member push against each other, the lock member can not move due to the large friction with the interior wall of the engagement groove even though the operating means is set at the unlock position to try to remove the lock member from the engagement groove. Tilt of the supported member is, therefore, maintained to be locked and the impetus giving means also accumulates the impetus. This involves the tilt of the supported member to be self-held.

When giving the external force to the self-held supported member so that the reaction force given by the reaction force imparting mechanism is weakened, the pushing force between the interior wall of the engagement groove and the lock member becomes small to reduce the friction force. Furthermore, when the friction force becomes smaller than the impetus in the direction for removing the lock member by the impetus giving means, the lock member is removed from the engagement groove by the impetus giving means. This causes the locked state maintained by the lock member and the engagement groove to be cancelled and the supported member enters the unlocked state to be capable of rocking, and the supported member thereby returns to its initial position by the impetus from the reaction force imparting mechanism.

Therefore, according to this rocking apparatus, it is possible to prevent the supported member from suddenly springing up. Additionally, since the mechanism has a simple structure, the manufacturing cost or complexity of the assembling work can be suppressed to the same level as the conventional rocking apparatus having no self-holding mechanism.

In addition, it is preferable to adopt the position holding means which can maintain the operating means at both the lock position and the unlock position and adopt the impetus giving means for elastically giving an impetus in both the direction for removing the lock member from the engagement groove and the direction for fitting the lock member in the engagement groove. In this case, the self-holding function is effected not only when removing the lock member from the engagement groove of the locked member but also when fitting the lock member in the engagement groove. That is, in case of switching the operating means to the lock position to try fitting the lock member in the engagement groove, if the position of the lock member deviates from that of the engagement groove, the lock member comes into contact with the locked member and it can not be fitted in the engagement groove, thus accumulating the elastic force in the impetus giving means. If a change in degree of the external force applied to the supported member causes the position of the locked member to be shifted in the rocking direction, the lock member is fitted into the engagement groove by an impetus from the impetus giving means when the position of the lock member matches with that of the engagement groove, entering the locked state.

Therefore, according to this rocking apparatus, by switching the operating means to the unlock position or the lock position in advance, an impetus is kept to be given to the lock member until a change in the external force applied to the supported member causes the positional shift between the lock member and the engagement groove, and fitting or removal of the lock member into or from the engagement groove is enabled and can be effected. Thus, the locking operation can be improved.

Further, the impetus giving means may preferably comprise: a switching arm for engaging with the lock member in a direction that the lock member slides; a switching lever associated with the operating means to be switched between and held at the lock position and the unlock position; an elastic body provided between the switching lever and the switching arm; and a holding member for holding the switching lever at the lock position and the unlock position. In this case, the elastic body provided between the switching arm and the switching lever separates the movement of the switching lever from that of the switching arm with the lock member being prohibited from moving and the states of the switching lever and the switching arm can be easily maintained. When oscillation of the supported member enables movement of the lock member, the elastic force accumulated in the elastic body can rock the switching arm to slide the lock member without moving the switching lever. According to this rocking apparatus, the elastic body therefore enables self-holding of the supported member.

In addition, the rocking apparatus according to the present invention may preferably comprise: a first rotary shaft which integrally rotates with the operating means; a second rotary shaft provided on the same axis with the first rotary shaft with their ends being close to each other; an arm which integrally rotates with the second rotary shaft and is rotatably supported on the first rotary shaft; and a connecting means for rotatably connecting ends of these rotary shafts. In this case, since the first and second rotary shafts can be prevented from coming off and the first rotary shaft can have both the function for operating the operating means and the function for supporting the arm operated by the second rotary shaft, a number of parts required for mounting the rotary shafts can be decreased to intend reduction in size and weight of the rocking apparatus.

In the rocking apparatus according to the present invention, it is preferable that the locked member also serves as a strut which is one of three supporting points for supporting the supported member. In this case, it is possible to manufacture the rocking apparatus having the lock mechanism in a small space with one of its parts being eliminated.

The rocking apparatus having the above configuration is not restricted to a specific application and can be applied to various kinds of apparatus, device, furniture and others which can support the supported member on the supporting member in such a manner that the supported member can rock around one rotary shaft. In particular, it is preferable that the rocking apparatus is applied to one for inclining a seat of a chair and the supported member is used as a seat constituent member and the supporting member is used as a seat bearing member supported on a leg. In this case, since large brackets which are long in the front-and-back direction are not required between the seat bearing member and the seat and the supported member can be supported on only three points using small parts, degree of freedom in design is enhanced without deteriorating the appearance of the chair as compared with the prior art chair. As different from the large brackets, since the small parts are used for supporting, these fitting parts and the supported member can be integrally molded to reduce a number of parts, and the assembling work can be eliminated to simplify the assembling process of the chair. Accordingly, the cost for manufacturing the chair can be lowered.

In addition, the lock mechanism according to the present invention is not restricted to using for the rocking apparatus adopting the three-point support described above, and it can be also embodied in a general rocking apparatus to obtain the similar advantages and results.

DETAILED DESCRIPTION OF PREFERRED EMBODIMENTS

Figure 1:
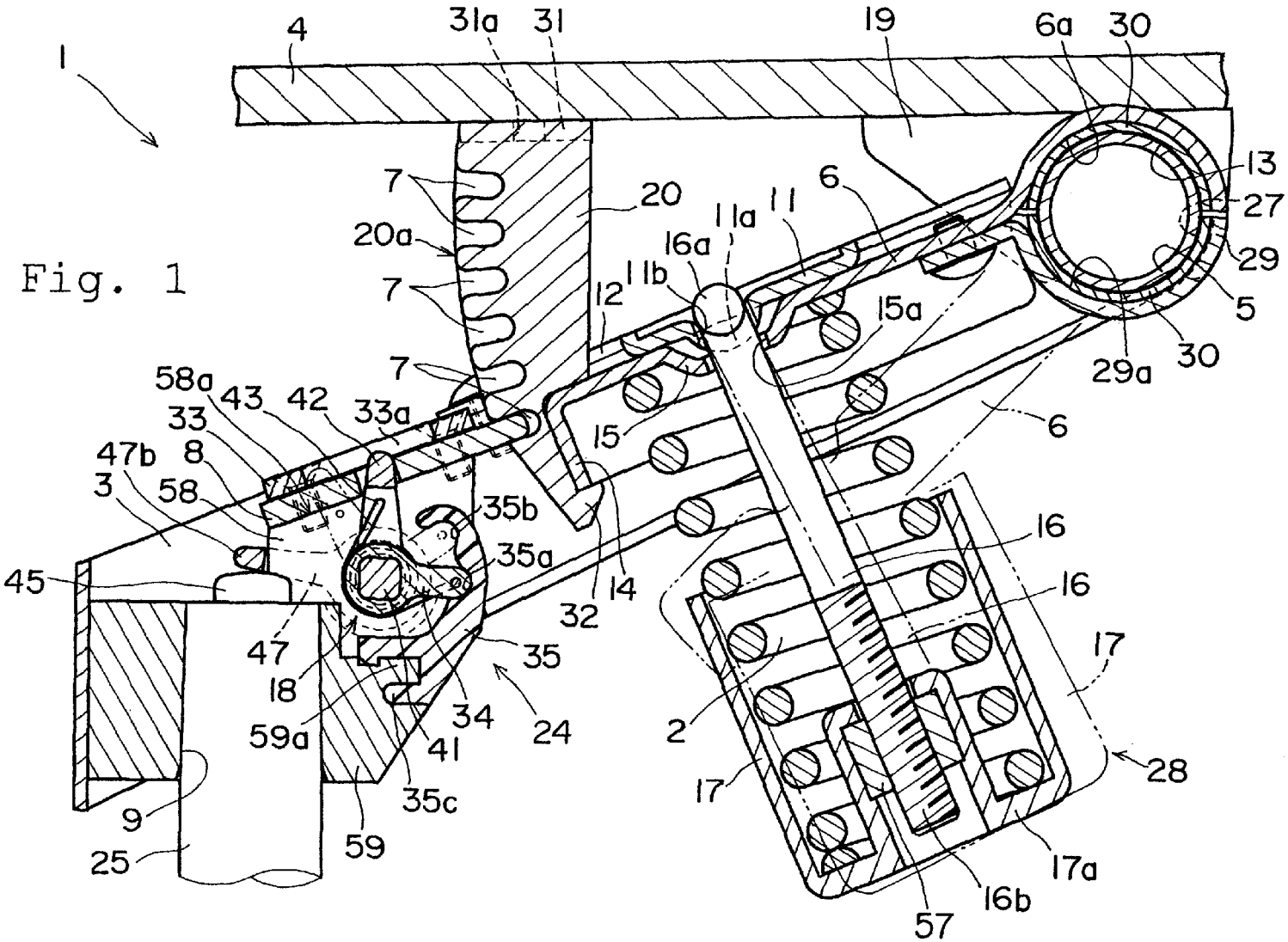
FIG. 1 is a vertical sectional side view showing a rocking apparatus according to the present invention.

The structure of the present invention will now be described in detail hereunder based on an illustrative embodiment. FIGS. 1 through 7 show a preferred embodiment in which a rocking apparatus 1 according to the present invention is mounted in a chair. In this specification, the front-and-back direction means the front-and-back direction of a chair; the horizontal direction, the right-and-left direction of a chair; and the vertical direction, the vertical direction of a chair.

The rocking apparatus 1 supports a seat (only a seat plate 4 which is a core material of the seat is shown in the drawing) which is a first supported member on a seat bearing member 3, which is a second supporting member in such a manner that the seat can rock around a supporting shaft 5 which serves as one swivel shaft, and gives an impetus to the seat plate 4 toward its initial or base position by using a reaction force imparting mechanism 28. Specifically, the rocking apparatus 1 is provided with: the above-described seat bearing member 3; the supporting shaft 5 which is fixed to the seat bearing member 3 and supports the seat plate 4 at two distant points, e.g., both ends; a pair of connecting members 19, 19 for respectively connecting the supporting shaft 5 and the seat plate 4 at two seat plate supporting points to rotatably support the seat plate 4 on the seat bearing member 3; a reaction force member 6 (also called a reaction force imparting member) which is supported by the supporting shaft 5 to oscillate and be constantly pushed toward its initial position (solid line in FIG. 1) by the reaction force imparting mechanism 28; and a strut 20 which is provided between the reaction force member 6 and the seat plate 4 at a position corresponding to one apex of a triangle. Strut 20 is connected to either the reaction force member 6 or the seat plate 4 to support the seat plate 4 by the reaction force member 6. The other two apices of the triangle are occupied by the two connecting members 19, 19 thereby supporting the supported member 4 on the reaction force member 6 and the supporting shaft 5 by the three-point support using the connecting members 19, 19 and the strut 20.

Further, the rocking apparatus 1 in this embodiment includes a fixing mechanism for fixing the seat plate 4 which is the supported member at an arbitrary position and/or angle. This fixing mechanism consists of a locked member and a lock member and, in this embodiment, the strut 20 which is one of the three seat plate supporting points of the rocking apparatus 1 also functions as the locked member that is, the member to be locked (the strut will be referred to as the locked member or member to be locked hereunder). In other words, the rocking apparatus 1 is provided with: a locked member 20 which has a plurality of engagement grooves 7, . . . , 7 aligned in a rocking direction of the seat plate 4 and is attached to the seat plate 4; a lock member 8 which is attached to the seat bearing member 3 so as to slide in a direction that it fitted in or removed from the engagement groove 7 and locks the tilt position of the seat plate 4 when fitted in the engagement groove 7; a lock operation lever 18 as an operating means which is switched between the lock position and the unlock position and held at least in the unlock position; and an impetus giving or drive means 24 provided between the lock operation lever 18 and the lock member 8 to transmit movement of the lock operation lever 18 to the lock member 8.

Figure 10:
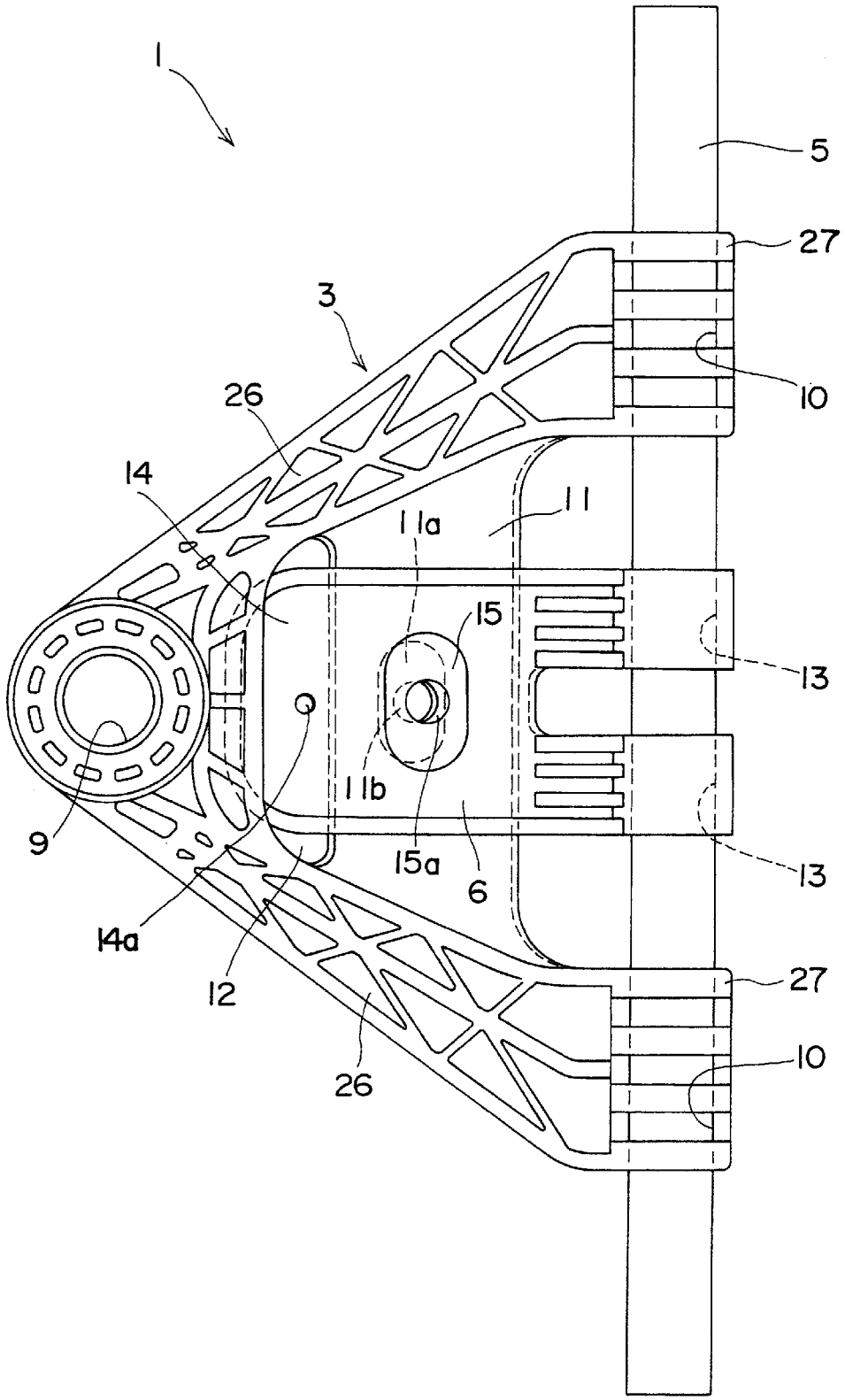
FIG. 10 is a bottom view showing the tilting apparatus for a chair.
Figure 11:
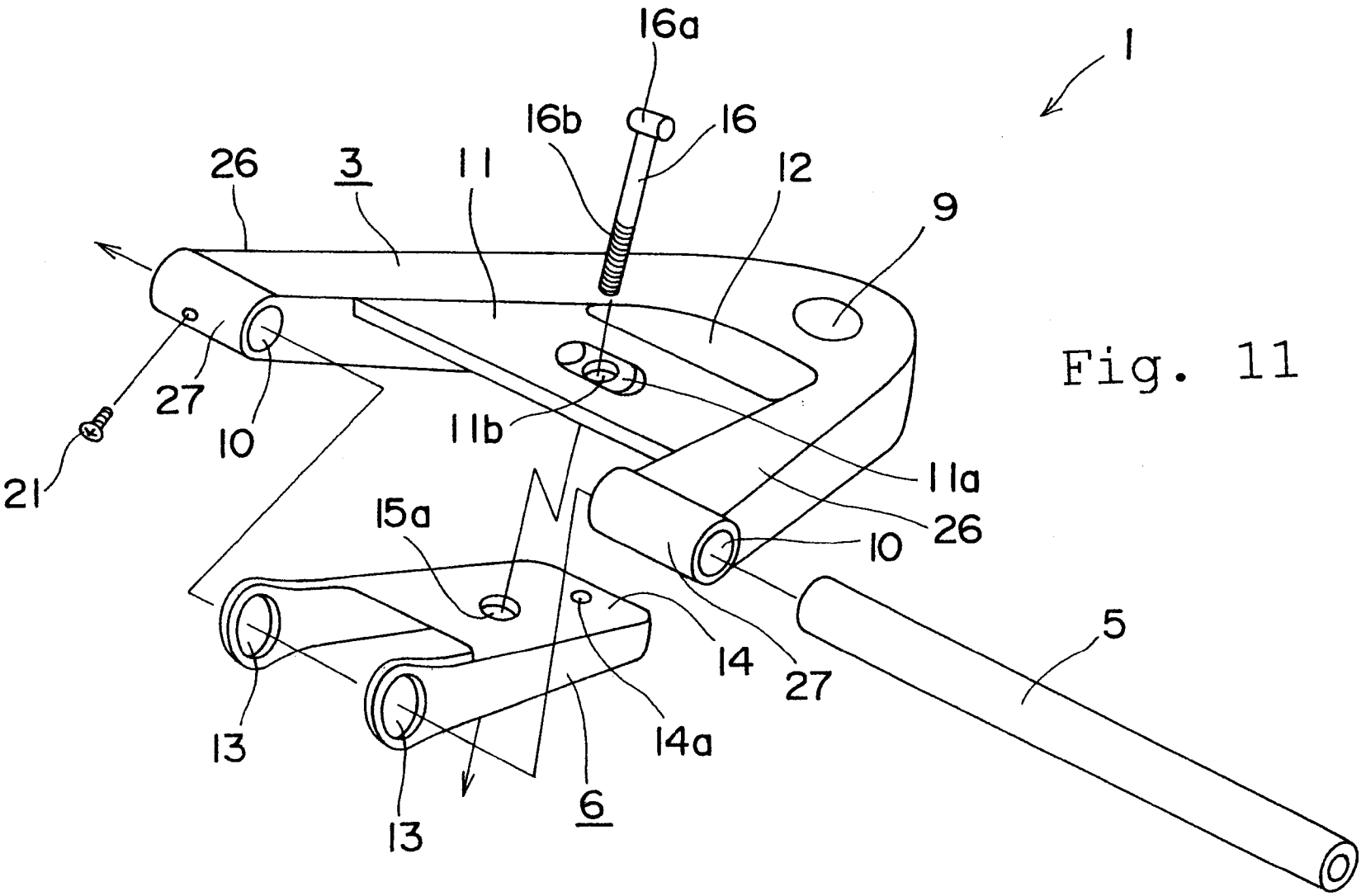
FIG. 11 is an exploded assembly view showing another embodiment of the rocking apparatus.

The seat bearing member 3 is supported on a leg 25 and supports the seat plate 4 in such a manner that the seat plate 4 can tilt or pivot around the supporting shaft 5. The seat bearing member 3 includes: two arms 26, 26 diverging outwardly from each other toward the front side in a substantially-V shape; a base end block 59 provided on a rear end at which the respective arms 26, 26 are connected; a leg receiving hole 9 consisting of a through hole formed in the base end block 59 and opened in the vertical direction; bearing portions 27, 27 for bearing the supporting shaft 5 formed at the front end of each arm 26, 26; and a connecting plate 11 for connecting the arms 26, 26 at the center of the respective arms 26, 26. The seat bearing member 3 is fixed on an upper end of the leg 25 by pressing and inserting the upper end of the rotatable leg 25 into the leg receiving hole 9. The seat bearing member 3 is made of metal and is integrally molded with at least the base end block 59 and both arms 26, 26 by, e.g., casting or welding. Although metal is used to integrally mold the seat bearing member 3 in this embodiment, the present invention is not restricted thereto and integral molding may be performed or separately-molded products may be jointed by using synthetic resin or the like. In case of forming the seat bearing member 3 using the synthetic resin, it is preferable that a plurality of ribs are formed in both the arms 26, 26 to enhance rigidity as shown in FIG. 10. In this case, both arms 26, 26 can be made thin and light, and hence freedom in design of a chair can be improved.

Figure 2:
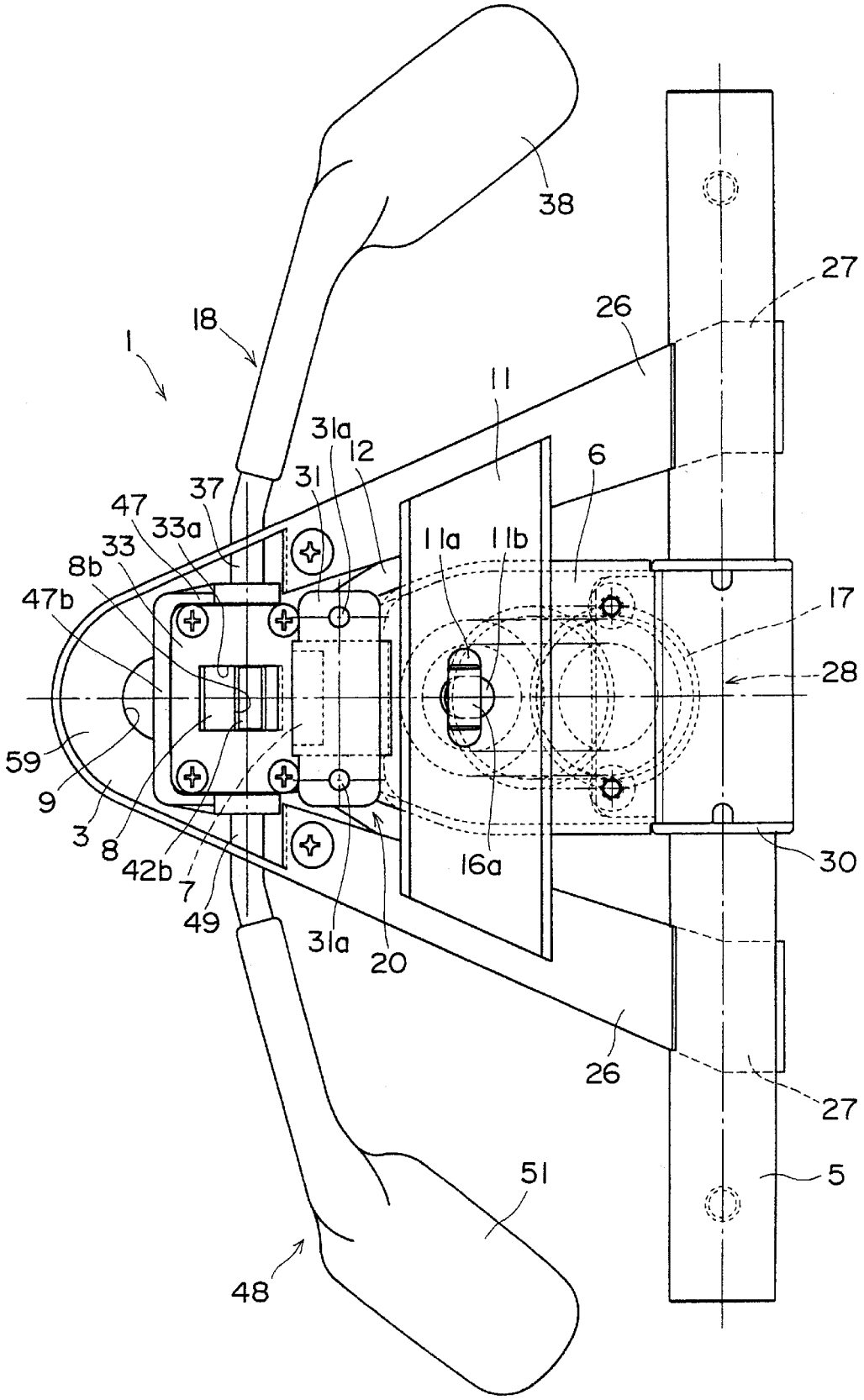
FIG. 2 is a plan view showing the rocking apparatus.
Figure 3:
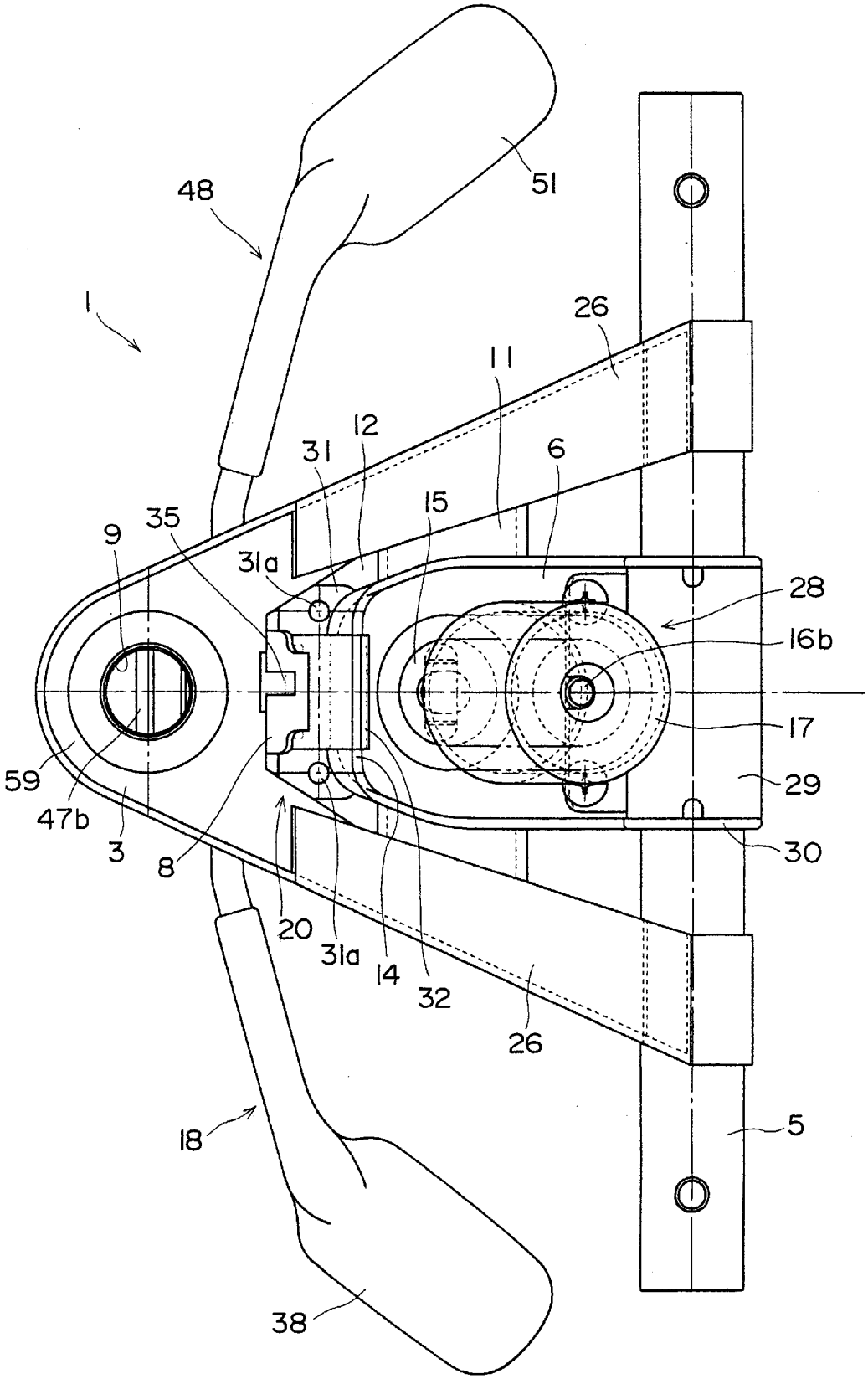
FIG. 3 is a bottom view showing the rocking apparatus.
Figure 4:
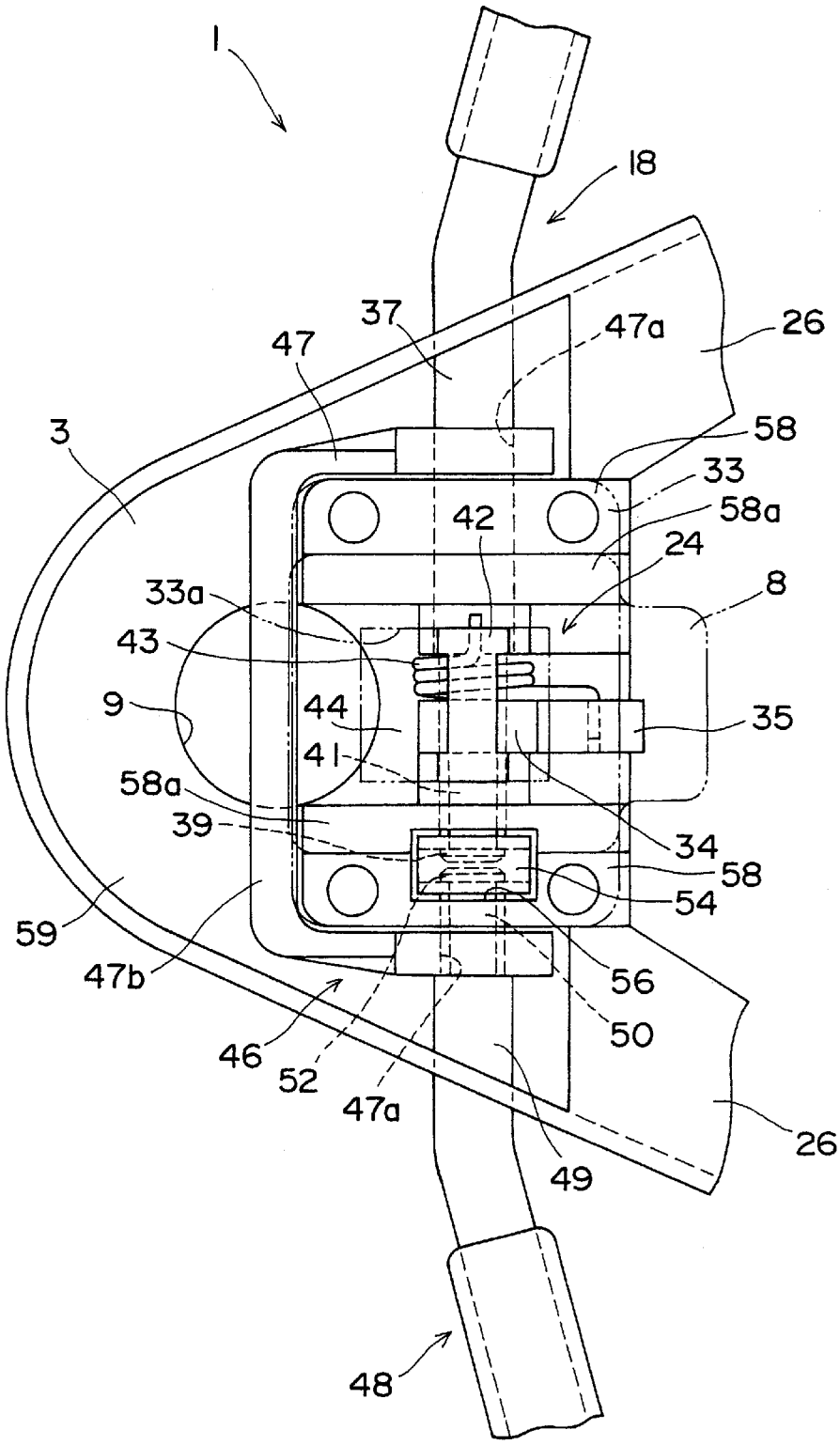
FIG. 4 is a plan view showing a primary part of the rocking apparatus.
Figure 5:
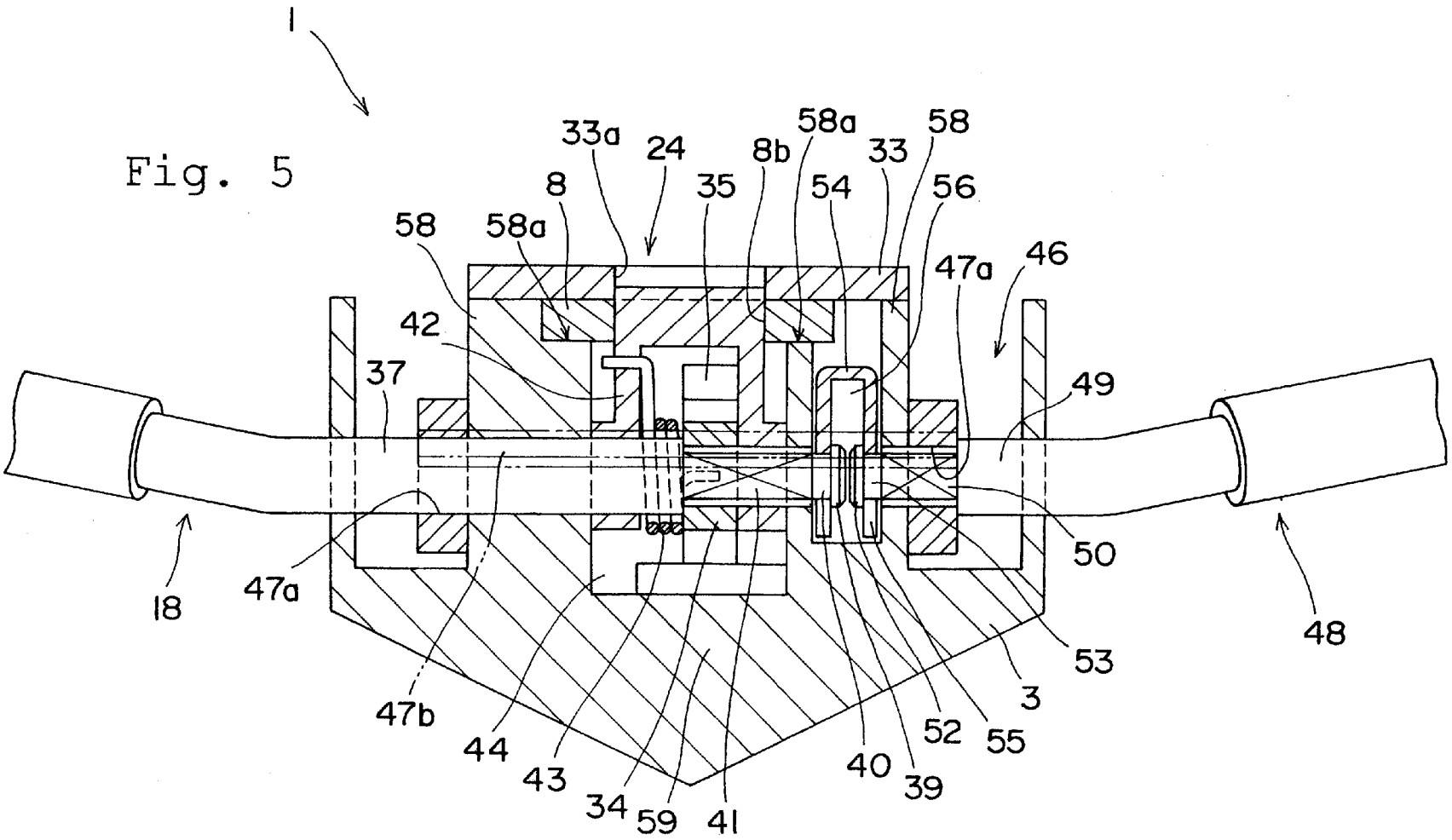
FIG. 5 is a vertical sectional rear elevation showing a primary part of the rocking apparatus.
Figure 6:
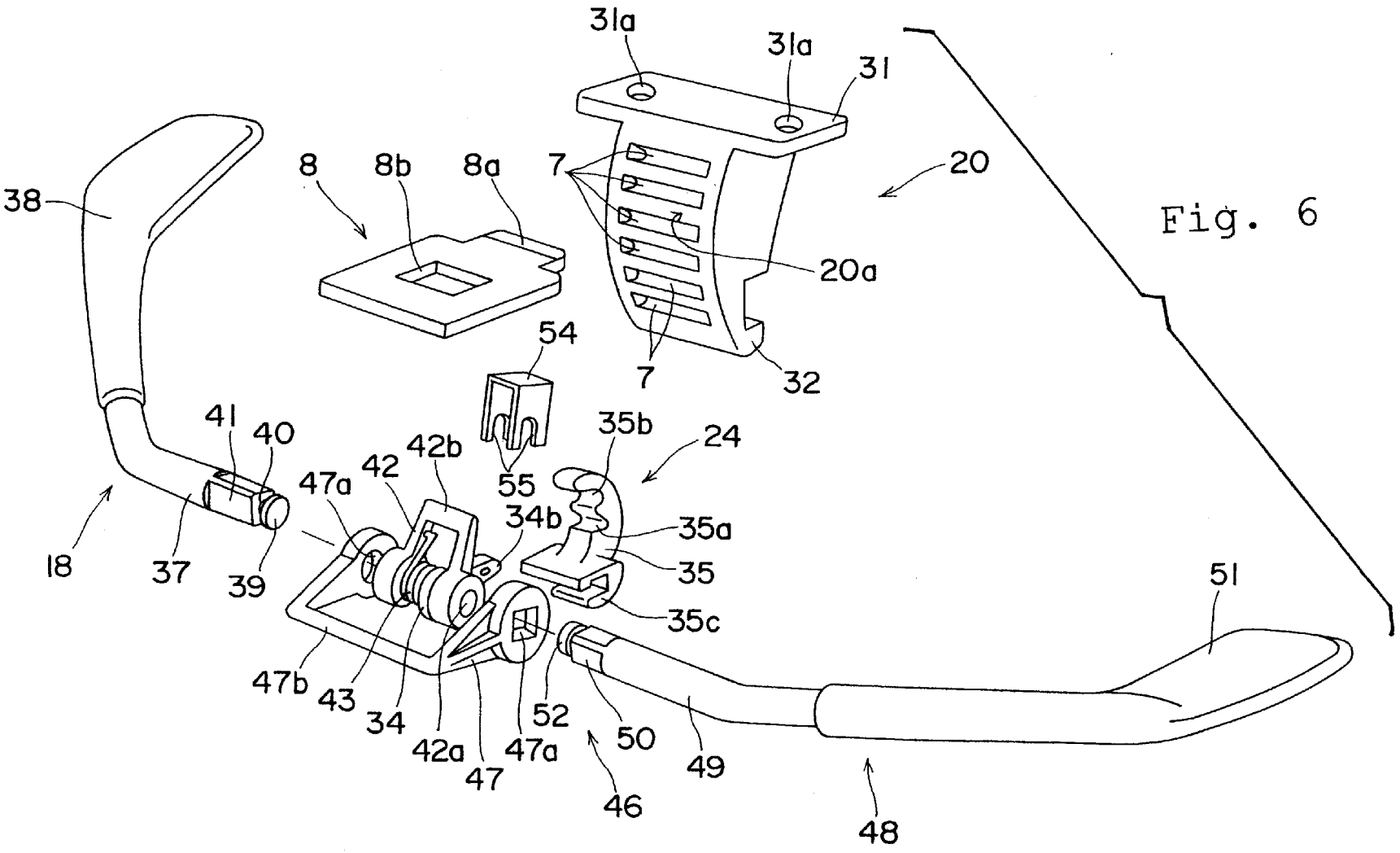
FIG. 6 is an exploded assembly view showing a primary part of the rocking apparatus.
Figure 7:
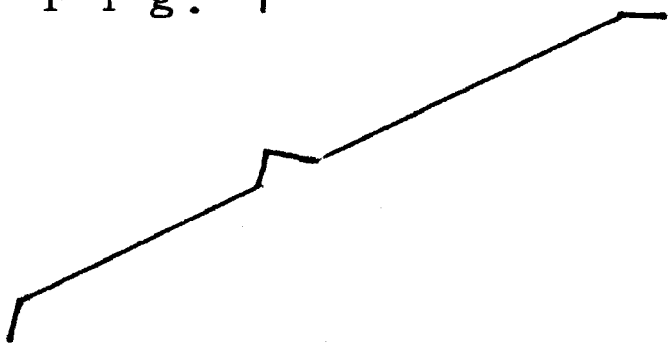
FIG. 7 is an exploded assembly view showing an impetus giving or biasing means.
Figure 7:
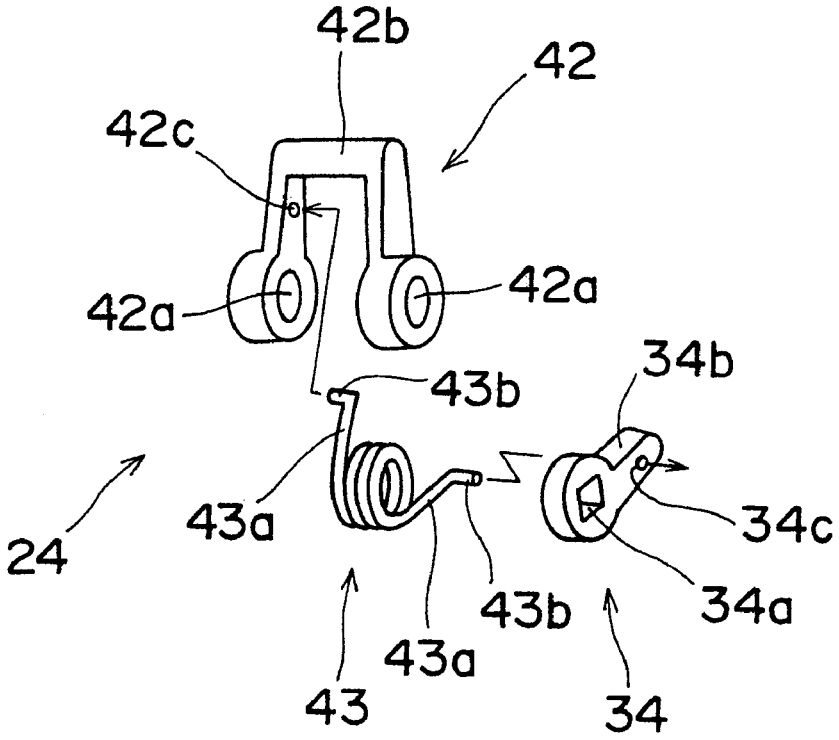

Each bearing portion 27 is made into a semi-cylindrical shape forming a groove opened upwards as shown in FIG. 2, and one supporting shaft 5 projecting toward the left and right of the seat bearing member 3 is fixed to the bearing portions 27, 27 by, for example, welding so as not to rotate. The supporting shaft 5 rotatably bears the seat plate 4. It is to be noted that arm rests and the like or caps may be attached on both ends of the supporting shaft 5. A bearing portion 27 having an appropriate shape is adopted in accordance with the cross section of the supporting shaft 5. For example, if the supporting shaft 5 having a rectangular, triangular or elliptic cross section is adopted, the bearing portions 27, 27 each having the shape associated with that cross section are employed.

The supporting shaft 5 is an iron pipe having a circular cross section. Although the supporting shaft 5 is the iron pipe in this embodiment, the invention is not limited thereto and a solid iron rod may be used. The material of the supporting shaft 5 is not restricted to iron, and metal such as aluminum or plastic may be used. In any case, the seat plate 4 can be supported on the seat bearing member 3. Further, although this embodiment employs the bearing portions 27, 27 and the supporting shaft 5 fixed to each other by welding, the present invention is not limited thereto, and a set screw piercing through the bearing portions 27, 27 from the outside to the inside may be provided to fix these members for example. If this set screw is provided on a circumferential wall of least one of the two bearing portions 27, 27, the supporting shaft 5 can be fixed to the bearing portions 27, 27 so as not to rotate.

The relationship between the seat bearing member 3 and the supporting shaft 5 is not restricted to that described above, and the supporting shaft 5 may be supported by being inserted into the respective bearing portions 27, 27 consists of supporting holes 10 piercing in the right-and-left direction of ends of both the arms 26, 26, as in another embodiment shown in FIGS. 8 through 12. In this case, the set screw 21 is fastened from the outside of the bearing portion 27 and the supporting shaft 5 is pushed against the interior wall of the supporting hole 10 to fix each bearing portion 27 and the supporting shaft 5.

The seat bearing member 3 is provided with a connecting plate 11 for connecting the both arms 26, 26 at the central part of the respective arms 26, 26 and a vertically-piercing opening portion 12 formed on the rear side of the connecting plate 11. The connecting plate 11 is connected with the reaction force imparting mechanism 28 and supports the seat plate 4 through the reaction force imparting mechanism 28 and the reaction force member 6. The connecting plate 11 has a recess portion 11*a* formed in the central part thereof whose longitudinal direction corresponds to the right and left direction and a through hole 11*b* formed in the center of the recess portion 11*a* in order to connect to the reaction force imparting mechanism 28. The locked member 20 for connecting the reaction force member 6 provided below the connecting plate 11 with the seat plate 4 positioned above the connecting plate 11 pierces through the opening portion 12 in such a manner that the locked member 20 can rock.

On the bottom side of the connecting plate 11 is provided the reaction force member 6 which is rotatably disposed to the supporting shaft 5 and supports the seat plate 4 while receiving the reaction force from the reaction force imparting mechanism 28. The reaction force member 6 includes a fitting portion 13 to which the supporting shaft 5 is rotatably fitted, and an engagement end 14 which is engaged with the locked member 20 extending through the opening portion 12 and supports the seat plate 4 through the locked member 20.

Figure 8:
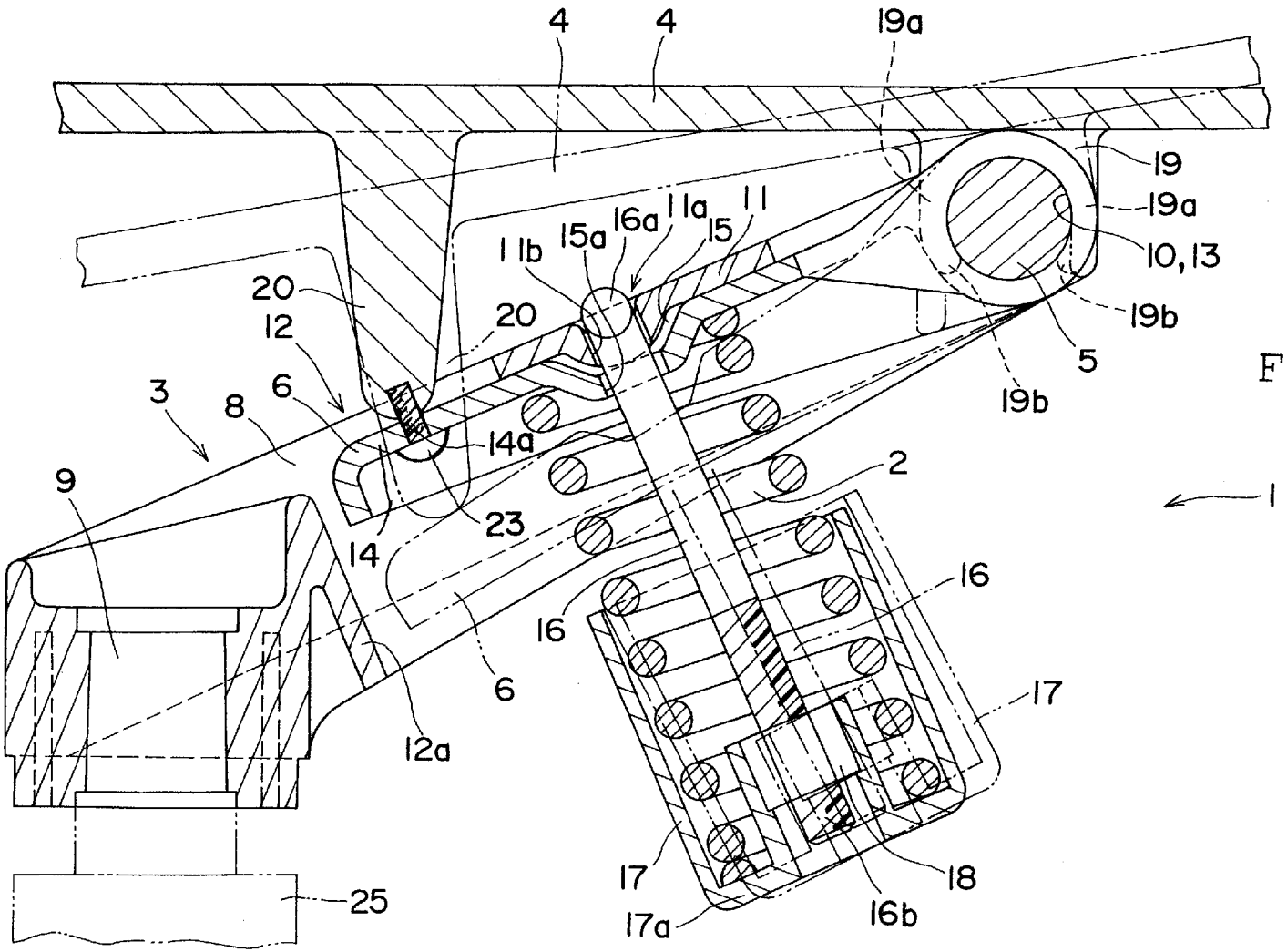
FIG. 8 is a vertical sectional side view showing a primary part of a tilting apparatus for a chair according to the present invention.
Figure 9:
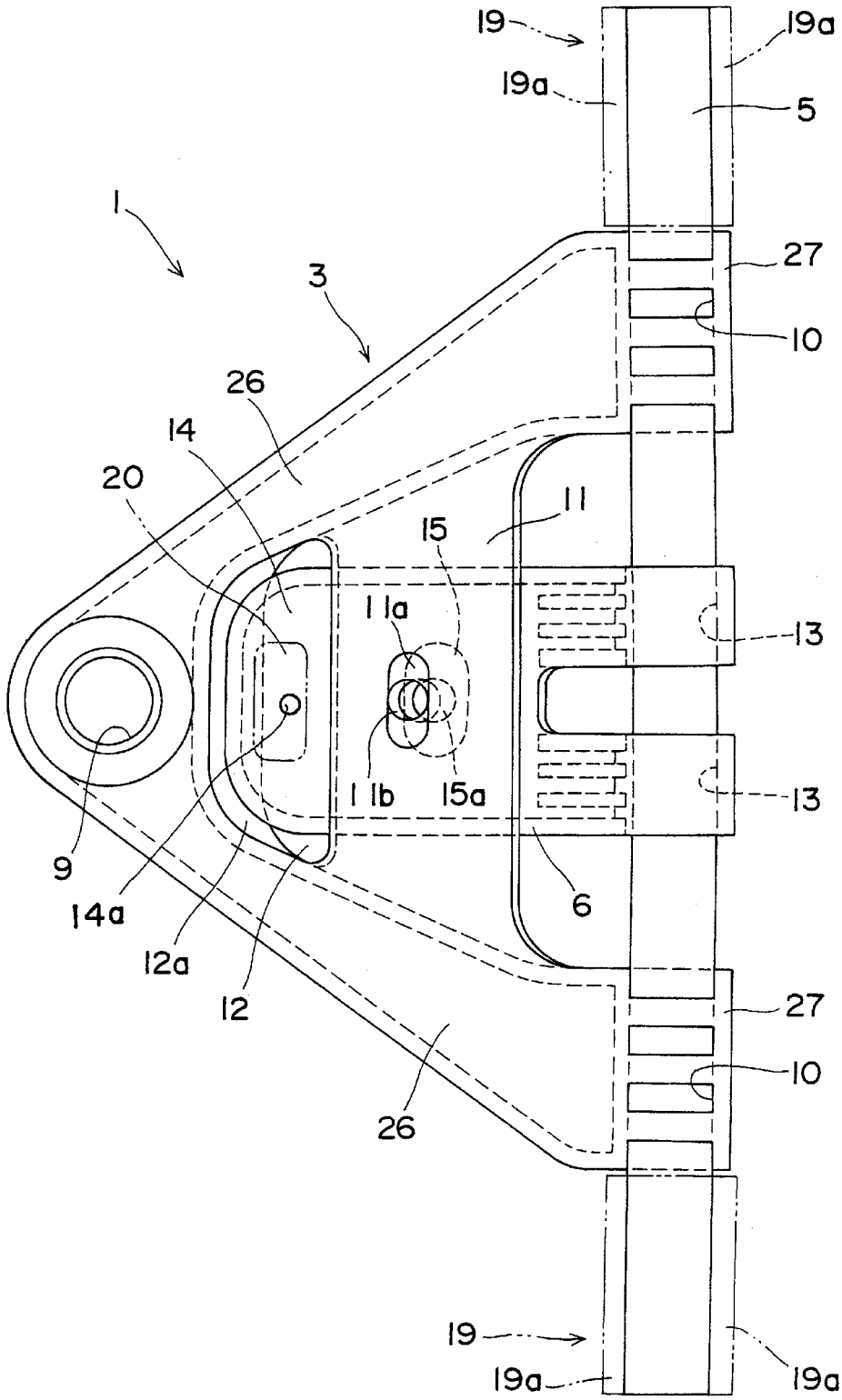
FIG. 9 is a plan view showing the tilting apparatus for a chair.

The fitting portion 13 is a through hole formed by arranging the upper groove 6*a* formed at the front end of the reaction force member 6 and the lower groove 29*a* of a lower plate 29 screwed on the lower side of the front end of the reaction force member 6 to be opposed to each other. Thus, the reaction force member 6 can be fixed to the supporting shaft 5 so as to sandwich the supporting shaft 5 between the reaction force imparting member 6 and the lower plate 29, and the reaction force imparting member 6 can be hence disposed to the supporting shaft 5 which has been already fixed to the seat bearing member 3 Further, inside the respective grooves 6*a* and 29*a* are provided vertically-divided sleeves 30, 30 made of, e.g., synthetic resin. The reaction force imparting member 6 can smoothly rotate around the supporting shaft 5. The supporting shaft 5 is vertically sandwiched together with the lower plate 29 and the reaction force imparting member 6 to fix the reaction force imparting member 6 to the supporting shaft 5 in this embodiment, but the present invention is not restricted thereto, and the fitting hole 13 may be provided to the reaction force imparting member 6 as shown in FIGS. 8 and 9 so that the supporting shaft 5 can be rotatably fitted to the fitting hole 13. In this case, the reaction force imparting member 6 can be also rotatably supported on the supporting shaft 5.

In addition, the reaction force imparting member 6 has an indent portion 15 opposed to the projecting back side of the recess portion 11*a* of the connecting plate 11 to accommodate this back side, and a through hole 15*a* formed in the center of the indent portion 15.

The reaction force imparting mechanism 28 is connected to the reaction force imparting member 6 and the connecting plate 11. The reaction force imparting mechanism 28 pushes and supports the seat plate 4 toward its initial position by upwardly pushing the reaction force imparting member 6 with respect to the connecting plate 11. The reaction force imparting mechanism 28 is provided with: a hanging bolt 16 connected with the connecting plate 11; a spring mount 17 fixed to the hanging bolt 16; and a helical compression spring 2 provided between the reaction force imparting member 6 and the spring mount 17 for giving an impetus so as to push the reaction force imparting member 6 toward the connecting plate 11 through the spring mount 17 and the hanging bolt 16.

The hanging bolt 16 pierces through the through hole 11*b* in the recess portion 11*a* of the connecting plate 11 and the through hole 15*a* in the indent portion 15 of the reaction force imparting member 6 from the upper side of the recess portion 11*a*. This hanging bolt 16 has a T-shaped head portion 16*a* and a screw portion 16*b* formed at the lower end. The head portion 16*a* is set in the recess portion 11*a*. Further, the diameter of each of the through holes 11*b* and 15*a* in the front-and-back direction is determined to be slightly larger than the outer diameter of the hanging bolt 16. The hanging bolt 16 can, therefore, rock around the head portion 16*a* in the front-and-back direction as shown in FIG. 1.

Figure 12:
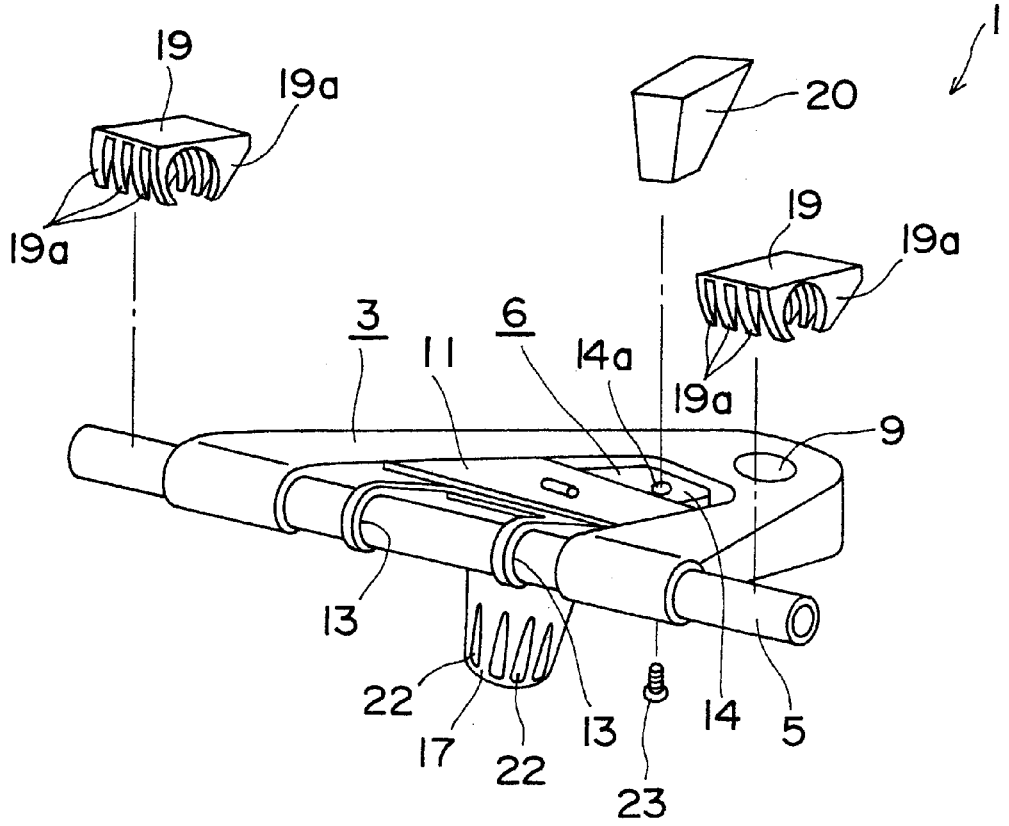
FIG. 12 is a perspective view showing another embodiment of the rocking apparatus.

To the screw portion 16*b* of the hanging bolt 16 is attached the substantially-cylindrical spring mount 17 having a bottom plate 17*a*. A nut 57 is fixed inside the central part of the bottom plate 17*a* of the spring mount 17 by insert molding or fixing. The hanging bolt 16 and the spring mount 17 are fixed by fastening the screw portion 16*b* of the hanging bolt 16 and the nut 57 in the spring mount 17. Since rotating the spring mount 17 causes the nut 57 to vertically move on the screw portion 16*b* by the screw pair, the fixing height of the spring mount 17 can be changed by its rotation. Moreover, vertical grooves 22 for antislipping is formed on the outer peripheral surface of the spring mount 17 as shown in FIG. 12. As a result, a user can readily rotate the spring mount 17 without any slippage.

In addition, the helical compression spring 2 is so provided as to surround the hanging bolt 16 between the bottom plate 17*a* of the spring mount 17 and the reaction force imparting member 6. Although the present embodiment employs the helical compression spring as a reaction force source in the reaction force imparting mechanism 28, this invention is not restricted thereto and any other elastic body such as a gas spring may be used. The helical compression spring 2 gives an impetus in such a manner that the reaction force imparting member 6 is pressed against the back side of the connecting plate 11. When the helical compression spring 2 is pressing the reaction force imparting member 6 against the back side of the connecting plate 11, the position of the seat plate 4 corresponds to an initial or base position.

Here, since the bottom plate 17*a* compresses the helical compression spring 2 to change an initial pressure by rotating the spring mount 17 to change the fixing height of the bottom plate 17*a*, a degree of the load required for rotating the reaction force imparting member 6 can be adjusted. Therefore, a degree of the force required for inclining the seat can be set to any level according to preference of a user, and the chair can be more comfortable to sit in.

Further, the seat is provided on the upper side of the seat bearing member 3. The seat is generally constituted by using the seat plate 4 as a core material, a cushion (not shown) mounted on the seat plate 4, and a covering material to cover the cushion. Also, the backrest (not shown) is provided on the rear portion of the seat by, e.g., integral forming. Thus, when a user rests his/her back on the backrest, he/she can rock the seat and the backrest. It is to be noted that the backrest can not be restricted to specific shapes.

The seat plate 4 is supported at right and left ends of the front portion thereof by the connecting members 19, 19 rotatably fitted with the both ends of the supporting shaft 5 and also supported at the central portion thereof by the locked member 20 which pierces through the opening portion 12 and engaged with the engagement end 14 of the reaction force imparting member 6.

The connecting member 19 includes a substantially-C-shaped nipping or damping claw 19*a* for clamping onto the supporting shaft 5 from the front and back sides, and an undercut type claw portion 19*b* positioned on the bottom side of the supporting shaft 5 as shown in FIGS. 8 and 12. For example, the connecting member 19 is made of plastic and is a bracket having a substantially-C-shaped clamping claw 19*a* which clamps the supporting shaft 5 from the front and back sides and reaches the bottom side of the supporting shaft 5 as shown in FIG. 9. A plurality of the claws 19*a* are formed along the axial direction of the supporting shaft 5. This decreases rigidity of each claw 19*a* to facilitate the fixing work with respect to the supporting shaft 5. When fixing each connecting member 19, 19 to the supporting shaft 5, the seat plate 4 is pushed from the upper side of the supporting shaft 5 and fitted by the one-touch manner while widening each claw 19*a*. Although the present embodiment describes the connecting member 19 having a plurality of clamping or nipping claws 19*a* provided along the axial direction of the supporting shaft 5, the present invention is not restricted to this configuration and a single nipping claw 19*a* may be used. In such a case, each connecting member 19 can be attached to the supporting shaft 5 by the one-touch manner.

The seat plate 4 is made of, for example, plastic and integrally molded with the connecting members 19, 19 by injection molding or the like. Although the seat plate 4 and the connecting members 19, 19 are integrally molded by injection molding using plastic in this embodiment, the present invention is not restricted thereto and the seat plate 4 and the connecting members 19, 19 may be separately molded and thereafter integrated by bonding or screwing. In case of separate molding, both or one of the seat plate 4 and the connecting members 19, 19 can be made of metal having high rigidity and wear resistance. Here, if the connecting members 19, 19 are made of metal having high rigidity, since these members are hard to be fitted to the supporting shaft 5 in the one-touch manner by using the nipping claw 19*a*, the connecting members 19, 19 are fitted to the supporting shaft 5 from its both ends in advance and the connecting members 19, 19 and the seat plate 4 are then fixed by screwing or the like. Further, the connecting members 19, 19 may be supported by the supporting shaft 5 by forming the connecting members 19, 19 into the annular shape and piercing the supporting shaft 5 through both the through holes. In this case, the connecting members 19, 19 are similarly fitted to the supporting shaft 5 from its both ends in advance and the connecting members 19, 19 and the seat plate 4 are then fixed by screwing or the like.

On the other hand, the locked member 20 supporting the central part of the seat plate 4 and also serving as a rear supporting member is provided with: a flange 31 having through holes 31*a* for inserting therethrough a bolt which is used for securing the seat plate 4; and an engagement claw 32 which is caught in and engaged with the lower portion of the engagement end 14 of the reaction force imparting member 6. The locked member 20 is fixed to the seat plate 4 when the flange 31 is screwed at a position where it is opposed to the opening portion 12 of the seat plate 4. Therefore, arrangements of the connecting members 19, 19 and the locked member 20 form apices of a triangle as shown in FIGS. 1 and 9, and the seat plate 4 is hence supported on the seat bearing member 3 through the connecting members 19, 19, the locked member 20, the supporting shaft 5 and the reaction force imparting member 6 with high stability. When the engagement claw 32 of the locked member 20 is caught in the lower portion of the engagement end 14 of the reaction force imparting member 6, the locked member 20 and the engagement end 14 can be united into one body. This can prevent the seat plate 4 from coming up frontward even through the chair is inclined frontward when the seat plate 4 is not locked by the lock member 8.

The locked member 20 also serving as a rear supporting member is fixed to the reaction force imparting member 6 by engaging the engagement claw 32 of the locked member 20 with the reaction force imparting member 6 in this embodiment, but the present invention is not limited thereto and the locked member 20 may be fixed to the reaction force imparting member 6 by using a set screw 23 inserted through the through hole 14*a* at the rear end of the reaction force imparting member 6 as shown in FIGS. 8 through 12, for example. This can also prevent the seat plate 4 from coming up frontward even through the chair is inclined frontward when the seat plate 4 is not locked by the lock member 8. Further, the height of the locked member 20 is set in such a manner that the seat can be, e.g., substantially horizontal while determining the position of the seat at the time of applying no load to the seat as the initial position of the seat. However, it is needless to say that the initial position does not have to be horizontal and may have an inclination angle.

In addition, the locked member 20 also serves as a strut in this embodiment, but the present invention is not restricted to this configuration, and the locked member and the strut may be formed by using different members. In such a case, the locked member does not have to be brought into contact with the reaction force imparting member 6, and it may be arranged at a point apart from the reaction force imparting member 6. In case of separately providing the locked member and the strut, the rocking apparatus can independently exist irrespective of the lock mechanism as shown in FIGS. 8 through 12.

As described in the embodiment shown in FIG. 1 through 7, the seat plate 4 and the locked member 20 can be formed by using different members and united into one body by screwing or the like. In this example, the locked member 20 can be made of metal having high rigidity. Although this embodiment employs different members to form the seat plate 4 and the locked member 20, the present invention is not restricted thereto, and they can be integrally formed by using, e.g., plastic or metal.

Moreover, a plurality of engagement grooves 7, . . . 7 are formed on a rear surface 20*a* of the locked member 20. The rear surface 20*a* is a convex cylindrical surface with the supporting shaft 5 as its central line. The lock member 8 is disposed behind the locked member 20. Since the fitting length of the lock member 8, which is opposed to the engagement groove 7, in the engagement groove 7 can be fixed irrespective of a rocking angle of the seat plate 4, the certainty of fitting of the lock member 8 and the engagement groove 7 can be secured. Although the rear surface 20*a* of the locked member 20 is a convex cylindrical surface with the supporting shaft 5 as its central line in this embodiment, the present invention is not limited thereto, and it may be a concave cylindrical surface with the supporting shaft 5 as its central line. In this case, the lock member 8 is provided in front of the locked member 20. The fitting length of the lock member 8 in the engagement groove 7 can be also fixed in this example, and the certainty of fitting of the lock member 8 and the engagement groove 7 can be thus secured.

Each engagement groove 7 of the locked member 20 has an oblong shape, and the multiple engagement grooves 7 are formed in the rocking direction, i.e., the vertical direction of the seat plate 4 at intervals. The interior of each engagement groove 7 has a flat surface. A number of the formed engagement grooves 7 corresponds to a number of positions (namely, a number of steps) at which tilt of the seat can be locked. The interval between the respective engagement grooves 7 determines an inclination angle between the lock positions for tilt of the seat. The number of or the interval between the engagement grooves 7 are set with taking into account the operability of the chair to be applied.

The lock member 8 is attached at the seat bearing member 3 in such a manner that it can slide; it can be fitted in or removed from the engagement groove 7 by sliding; and it locks tilt of the seat plate 4 when fitted in the engagement groove 7. The lock member 8 consists of a board, and includes a lock portion 8*a* which is formed at a front end of the lock member 8 and can be fitted in the engagement groove 7 and an engagement hole 8*b* which is formed in the central part of the lock member 8 and engaged with the impetus giving or drive means 24.

The lock member 8 is so supported as to be capable of sliding by a slide supporting portion 58*a* whose shape is obtained by cutting into the step-like form the inside of the upper part of each supporting wall 58, 58 formed on the right and left sides of the upper part in front of the leg receiving hole 9 of the seat bearing member 3. A cover plate 33 is screwed on the top of the supporting walls 58, 58. The cover plate 33, therefore, prevents the lock member 8 from falling from the slide supporting portion 58*a*. The vertical movement of the lock member 8 is restricted by the supporting walls 58, 58 and the cover plate 33. Further, the lock member 8 is so supported as to be capable of oscillating in the front-and-back direction at a position where the lock portion 8*a* can be fitted in or removed from the engagement groove 7. When the lock member 8 slides frontward, the lock portion 8*a* is fitted in the engagement groove 7. Here, the lock member 8 stretches over the space between the supporting walls 58, 58 and the cover plate 33 and the engagement groove 7, and oscillation of the locked member 20 is hence restricted by the supporting walls 58, 58 and the cover plate 33 through the lock member 8. When the locked member 20 can not oscillate, tilt of the seat is locked. Further, when the lock member 8 oscillates toward the rear side, the lock portion 8*a* is removed from the engagement groove 7. Here, the locked member 20 becomes capable of oscillation, and the seat is unlocked to be capable of oscillation.

Further, the peripheral portions of the lock portion 8*a* and the engagement groove 7 are trimmed and rounded. Thus, the lock portion 8*a* is guided by the trimmed peripheral portions to be easily fitted in the engagement groove 7 even if the lock portion 8*a* is pushed at a position slightly shifted from the engagement groove 7 in the vertical direction.

In order to slide the lock member 8, the lock operation lever 18 connected to the lock member 8 through the impetus giving means 24 is operated. The lock operation lever 18 includes a shaft portion 37 as a first rotary shaft rotatably disposed to the seat bearing member 3 and an operating portion 38 used by a user to switch the locked state. The shaft portion 37 is inserted into a through hole formed on the lower portion of the supporting wall 58 of the seat bearing member 3. This ensures the shaft portion 37 to be rotatably supported by the supporting wall 58. An engagement groove portion 40 consisting of a groove surrounding the shaft portion 37 is formed at an end of the shaft portion 37. A flange 39 is formed to the engagement groove portion 40 at its end in the axial direction. Further, A fitting portion 41 having a substantially-rectangular cross section is formed to the engagement groove portion 40 by the side of the operating portion 38.

The operating portion or handle 38 is provided to the shaft portion 37 so that the operating portion 38 is bent frontward. The top end of the operating portion 38 is positioned in the vicinity of the supporting shaft 5. In other words, the top end of the operating portion 38 is positioned in the vicinity of the center of oscillation of the seat plate 4. Thus, the position of the top end of the operating portion 38 rarely changes irrespective of an angle of tilt of the seat, and hence the substantially-constant operability can be maintained.

The impetus giving means 24 is provided between the lock operation lever 18 and the lock member 8. The impetus giving means 24 slides the lock member 8 by elastically transmitting rotation of the lock operation lever 18 to the lock member 8.

The impetus giving means 24 is composed of: a switching arm 42 engaged with the lock member 8 in the sliding direction of the lock member 8; a switching lever 34 associated with the lock operation lever 18 to be switched between the lock position and the unlock position and held at the selected position; an impetus giving spring 43 which is an elastic body provided between the switching lever 34 and the switching arm 42; and a holding member 35 for holding the switching lever 34 at the lock position and the unlock position. The impetus giving means 24 is accommodated in an accommodation portion 44 consisting of a space between the supporting walls 58, 58 of the seat bearing member 3. The cover plate 33 is put and screwed on the upper side of the accommodation portion 44. A clearance hole 33*a* consisting of a rectangular through hole is formed in the central part of the cover plate 33. This prevents the switching arm 42 inserted through the engagement hole 8*b* of the lock member 8 to upwardly project from interfering with the cover plate 33.

The switching arm 42 moves the lock member 8 in the front-and-back direction by being engaged with the engagement hole 8*b* of the lock member 8 and oscillated by the impetus giving spring 43. The switching arm 42 has a substantially-channel-like shape as a whole and has coaxial circular through holes 42*a*, 42*a* formed at two base end portions and an engagement portion 42*b* configured to connect the two end portions. Each of the through holes 42*a*, 42*a* is rotatably disposed to the shaft portion 37 of the lock operation lever 18. The engagement portion 42*b* is fitted in the engagement hole 8*b* of the lock member 8. When the switching arm 42 rotates to move the engagement portion 42*b* frontward, the lock member 8 slides frontward to be fitted in the engagement groove 7. Also, when the switching arm 42 rotates to move the engagement portion 42*b* backward, the lock member 8 slides backward to come off the engagement groove 7.

Since the switching arm 42 is provided between the lock member 8 and the impetus giving spring 43 in this embodiment, the impetus can be smoothly transmitted from the impetus giving spring 43 to the lock member 8. The switching arm 42 is provided between the lock member 8 and the impetus giving spring 43 in this embodiment, but the present invention is not restricted to this configuration and the lock member 8 and the impetus giving spring 43 may be directly connected with each other. In this case, the impetus can be similarly transmitted from the impetus giving spring 43 to the lock member 8.

The switching lever 34 is integrated and associated with the lock operation lever 18. The switching lever 34 has a supporting hole 34*a* which is a square hole. The supporting hole 34*a* is fitted to the fitting portion 41 of the shaft portion 37 of the lock operation lever 18. Further, the horizontal cross sections of the supporting hole 34*a* and the fitting portion 41 are equal in shape and size. This ensures the switching lever 34 and the lock operation lever 18 to be integrated and rotate. Accordingly, when a user operates the operating portion 38 of the lock operation lever 18, the fitting portion 41 of the shaft portion 37 rotates to further rotate the switching lever 34.

In addition, the switching lever 34 is switched between the lock position and the unlock position by operating the lock operation lever 18 and held at either the lock position or the unlock position by the holding means 35. Here, the lock position means a point at which the switching lever 34 and the lock operation lever 18 are positioned in such a manner that the impetus giving means 24 elastically gives an impetus to the lock member 8 in the direction for being fitted in the engagement groove 7. Also, the unlock position means a point at which the switching lever 34 and the lock operation lever 18 are positioned in such a manner that the impetus giving means 24 elastically gives an impetus to the lock member 8 in the direction for being removed from the engagement groove 7.

The holding member 35 is engaged with a head portion 34*b* of the switching lever 34 in order to hold the switching lever 34 at either the lock position or the unlock position. The holding member 35 includes a lock groove 35*a* for elastically engaging and holding the head portion 34*b*' so as to set the switching lever 34 at the lock position and an unlock groove 35*b* for elastically engaging and holding the head portion 34*b* so as to set the switching lever 34 at the unlock position. This holding member 35 is made of plastic and integrally molded by injection molding. Therefore, by rotating the switching lever 34 held in either the lock groove 35*a* or the unlock groove 35*b*, the head portion 34*b* pushes the periphery of the groove toward the outside to widen the holding member 35 to rotate, and the head portion 34*b* can enters the other groove. This enables the switching lever 34 to be switched between the lock position and the unlock position and held at either of these positions.

In addition, an engagement claw portion 35*c* for attaching the holding member 35 to the seat bearing member 3 is formed to the lower portion of the holding member 35. The engagement claw portion 35*c* has two horizontal claws which are vertically aligned. A protrusion which protrudes downward is formed at the top end of the upper claw. On the other hand, a fixing portion 59*a* for fixing the engagement claw portion 35*c* is formed to the front portion of the base end block 59 of the seat bearing member 3. The fixing portion 59*a* has a hole for accommodating the lower claw and a concave in which the protrusion at the top end of the upper claw is set. When fixing the engagement claw portion 35*c* to the fixing portion 59*a*, the lower claw of the engagement claw portion 35*c* is first accommodated in the hole of the fixing portion 59*a* and the protrusion at the top end of the upper claw of the engagement claw portion 35*c* is then set in the concave of the fixing portion 59*a*. As a result, the holding member 35 can be easily fixed to the seat bearing member 3 by the one-touch manner without using any separate member such as a bolt.

Figure 13:
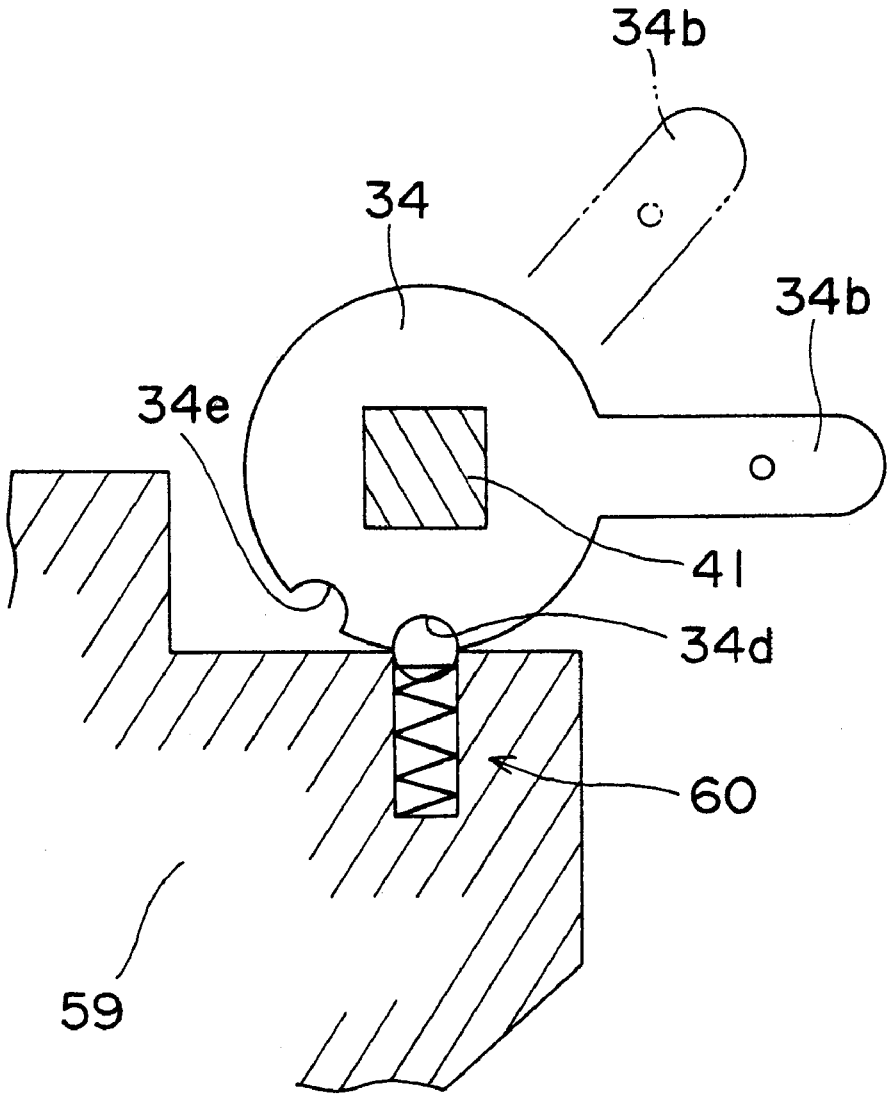
FIG. 13 is a side view showing anther embodiment of a switching lever.

Although the elasticity of the plastic holding member 35 is used for positioning the changeover of the switching lever 34 in this embodiment, the holding member 35 does not have to have the elasticity, and the holding member 35 may have rigidity and a plunger may be provided to the switching lever 34 to push the holding member 35, thereby positioning the changeover. Further, the lock groove 35*a* and the unlock groove 35*b* are formed to the holding member 35 in the foregoing embodiment, but the present invention is not restricted thereto and the lock groove 34*d* and the unlock groove 34*e* may be formed to the switching lever 34 itself and these grooves 34*d* and 34*e* may be pushed by, e.g., the plunger 60 formed to the base end block 59 to position the changeover as shown in FIG. 13. In this case, the holding member 35 may be omitted. The changeover of the switching lever 34 can be, of course, positioned by using any other means.

The impetus giving spring 43 acts as an elastic body provided between the switching lever 34 and the switching arm 42 and also slides the lock member 8 by elastically transmitting rotation of the lock operation lever 18 transmitted through the switching lever 34 to the lock member 8 via the switching arm 42.

As the impetus giving spring 43, a torsion coil spring is adopted in this embodiment. The impetus giving spring 43 is wound around the shaft portion 37 of the lock operation lever 18 in a space inside the switching arm 42. Both the ends of the impetus giving spring 43 have straight portions 43*a*, 43*a* obtained by straightening ends of the wound wire along the tangential direction, and hook portions 43*b*, 43*b* obtained by bending ends of the straight portions 43*a*, 43*a* so as to be parallel with the axial direction of the impetus giving spring 43 and be opposed to each other, respectively. One hook portion 43*b* is inserted into the through hole 42*c* formed at a part of the switching arm 42. Further, the other hook portion 43*b* is inserted into the through hole 34*c* formed at a part of the head portion 34*b* of the switching lever 34. Thus, the torsion is transmitted in such a manner that rotation of the switching lever 34 further rotates the switching arm 42 in the same direction.

Here, the impetus from the impetus giving spring 43 is so set as to be smaller than the friction force required for removing the lock member 8 from the engagement groove 7 when the external force does not act on the seat plate 4 but the reaction force from the reaction force imparting mechanism 28 is applied with the lock member 8 being fitted in the engagement groove 7 and be also smaller than the force for retaining the switching lever 34 at the lock position or the unlock position by the holding member 35. Therefore, even when movement of the lock member 8 is restricted by the locked member 20 and the switching arm 42 can not rotate, the impetus is accumulated in the impetus giving spring 43 by rotating only the switching lever 34. In addition, even if the impetus of the impetus giving spring 43 is used to try to rotate the switching lever 34, the position of the switching lever 34 is maintained by the holding member 35 and the impetus is thereby accumulated in the impetus giving spring 43 because the retaining force of the holding member 35 is stronger than the impetus.

On the other hand, the seat bearing member 3 is supported on the leg 25 by fitting the upper end portion of the leg 25 in the leg receiving hole 9. A gas spring is provided to the upper end portion of the leg 25. An adjustment pin 45 for the gas spring protrudes from the upper end portion of the leg 25. Thus, the fluid in the gas spring can freely flows by pushing the adjustment pin 45, and the length of the gas spring can be thereby variable. Moreover, the length of the gas spring can be fixed by releasing the adjustment pin 45 from being pushed. This can change and fix the length of the leg 25.

A pushing mechanism 46 which is a mechanism different from the rocking apparatus 1 and used for pushing the adjustment pin 45, is provided in the vicinity of the adjustment pin 45 for the gas spring. The pushing mechanism 46 has a pushing arm 47 capable of pushing down the adjustment pin 45 by rotation and a seat height operation lever 48 for rotating the pushing arm 47.

The seat height operation lever 48 is provided with a shaft portion 49 rotatably supported on the seat bearing member 3 and an operation portion 51 with which a user can change the height of the seat. As to the seat height operation lever 48 and the lock operation lever 18, their shaft portions 37 and 49 are arranged on the same axis and their end portions are so positioned as to be close to each other. The forwardly-bent operation portion 51 and the shaft portion 49 are united into one body. The shaft portion 49 is inserted into a through hole formed on the lower portion of the supporting wall 58 of the seat bearing member 3. With this structure, the shaft portion 49 is rotatably supported by the supporting wall 58. An engagement groove 53 consisting of a groove surrounding the shaft portion 49 is formed at the end of the shaft portion 49. A flange 52 is formed at the end of the engagement groove portion 53 in the axial direction. Furthermore, a fitting portion 50 having a substantially-rectangular cross section is formed to the engagement groove portion 53 by the side of the operation portion 51.

The operation portion 51 is provided to the shaft portion 49 so as to be forwardly bent. The end of the operation portion 51 is positioned in the vicinity of the supporting shaft 5. In other words, the end of the operation portion 51 is positioned in the vicinity of the center of oscillation of the seat plate 4. The position of the end of the operation portion 51 rarely changes irrespective of an angle of tilt of the seat, and the substantially-constant operability can be hence maintained.

The pushing arm 47 has a substantially-channel-like shape as a whole, and includes two coaxial through holes 47*a*, 47*a* formed at two base end portions and a pushing portion 47*b* for connecting the two end portions. These through holes 47*a*, 47*a* are supported by the shaft portions 37 and 49, respectively. Here, the through hole 47*a* supported by the shaft portion 49 of the seat height operation lever 48 is a square hole and fitted to the fitting portion 50 of the shaft portion 49. The seat height operation lever 48 and the pushing arm 47 integrally rotate. On the other hand, the through hole 47*a* supported by the shaft portion 37 of the lock operation lever 18 is a circular hole and fitted to a cylindrical part of the shaft portion 37 so as to be capable of relative rotation by free fit. Therefore, the pushing arm 47 rotates by operating the seat height operation lever 48 and is not affected by the operation of the lock operation lever 18. Further, since the pushing arm 47 is supported on two points, i.e., the seat height operation lever 48 and the lock operation lever 18, it is possible to prevent a twist caused by rotation of the pushing arm 47 when operating the seat height operation lever 48.

The pushing portion 47*b* is positioned so as to abut against the upper portion of the adjustment pin 45. Therefore, lowering the pushing portion 47*b* by operating the pushing arm 47 causes the adjustment pin 45 to be pushed down. Further, canceling the operation of the pushing arm 47 raises the adjustment pin 45 to push up the pushing portion 47*b*.

Additionally, there is provided a connecting means 54 for rotatably connecting ends of the respective shaft portions 37 and 49 of the lock operation lever 18 and the seat height operation lever 48 at the same time. This connecting means 54 has a substantially-channel-like shape and includes two claws 55, 55 at two end portions. A U-shaped groove is formed between the respective claws 55, 55. The connecting means 54 is put on the ends of the respective shaft portions 37 and 49 and the claws 55, 55 are rotatably fitted in such a manner that the engagement grooves 40 and 53 of the respective shaft portions 37 and 49 are sandwiched. The shaft portions 37 and 49 can be therefore rotatably connected to each other in the axial direction. This structure can prevent a plurality of rotary shafts from coming off by using a single member, thereby eliminating a number of parts. In addition, the shaft portions 37 and 49 are coaxial and arranged with the respective ends being close to each other, and the connecting means 54 can be hence reduced in size. Accordingly, minimization of the rocking apparatus 1 is possible.

Moreover, the connecting means 54 is housed in a connecting means accommodating portion 56 formed inside the supporting wall 58 by the side of the seat height operation lever 48 of the seat bearing member 3. Movement of the connecting means 54 is therefore restricted to the axial direction of the shaft portions 37 and 49 inside the connecting means accommodating portion 56, and the respective shaft portions 37 and 49 can be then prevented from moving even though the external force acts on the shaft portions 37 and 49 in the axial direction.

The upper part of the connecting means accommodating portion 56 is opened. When assembling the connecting means 54, the connecting means 54 is put from the top with the engagement groove portions 40 and 53 of the shaft portions 37 and 49 being positioned inside the connecting means accommodating portion 56 and the claws 55, 55 are thereafter mounted on the engagement groove portions 40 and 53, respectively. Further, the peripheral portion of the lock member 8 is disposed on the upper part of the connecting means accommodating portion 56. Consequently, when turning the chair upside down or to any other position, the connecting means 54 tries to spring out from the connecting means accommodating portion 56 but actually comes into contact with the lock member 8, thereby preventing such springing out.

The rocking apparatus 1 having the above-described arrangement operates in the following manner.

In the first place, with the rocking apparatus 1 being unlocked, when a user rests against the backrest and applies the load so as to incline the seat backward, the seat plate 4 rotates around the supporting shaft 5 in the backward direction. At this time, the locked member 20 pushes down the reaction force imparting member 6 with the supporting shaft 5 in the center. This causes the reaction force imparting member 6 to rotate around the supporting shaft 5 in the backward direction and the helical compression spring 2 is then compressed, thereby generating the reaction force. Here, when rotation of the reaction force imparting member 6 changes an angle with respect to the seat bearing member 3, the direction along which the helical compression spring 2 is pushed down varies. This causes the helical compression spring 2, the spring mount 17 and the hanging bolt 16 to tilt toward the front side (designated by the alternate long and two short dashes line in FIG. 1). The seat tilts toward the rear side receiving the reaction force from the helical compression spring 2, thereby enabling rocking.

Eliminating the load applied to the seat involves the helical compression spring 2 to push up the reaction force imparting member 6 until the reaction force imparting member 6 comes into contact with the connecting plate 11 in order to support the locked member 20, and the seat 4 thus returns to its original position. Here, since the locked member 20 is fixed to the engagement end 14, it is possible to prevent the seat 4 from spring up toward the front side with the supporting shaft 5 in the center by the impetus from the engagement end 14 for suddenly pushing up the seat 4.

When locking the inclination of the seat, rotating the lock operation lever 18 in the pushing-down manner causes the shaft portion 37 to rotate in the clockwise direction in FIG. 1, and the head portion 34*b* of the switching lever 34 is moved from the unlock groove 35*b* to the lock groove 35*a* to be fitted therein, thereby being held in the lock position. Rotation of the head portion 34*b* pushes the lock member 8 to protrude toward the locked member 20 through the impetus giving spring 43. Here, if the height of any engagement groove 7 of the locked member 20 is equal to that of sliding surface of the lock member 8, the lock portion 8*a* is directly inserted into the engagement groove 7.

Further, if the height of the engagement groove 7 of the locked member 20 is different from that of the lock member 8, the end of the lock portion 8*a* is brought into contact with the rear surface 20*a* of the locked member 20 and prevented from being inserted into the engagement groove 7, and hence twisting the impetus giving spring 43 allows the switching lever 34 to rotate. Accordingly, the lock member 8 receives the spring force of the impetus giving spring 43 and is maintained in the state where the lock member 8 is being pushed against the locked member 20. Therefore, when the seat is slightly inclined and the height of the lock portion 8*a* becomes equal to that of the engagement groove 7, the lock portion 8*a* is pushed into the engagement groove 7 by the spring force in the sliding manner. Since it is unnecessary to keep pushing down the operation portion 38 until the lock operation is completed, thereby improving the operability.

Further, trimming the peripheral portions of the lock portion 8*a* and the engagement groove 7 facilitates the fitting of the lock portion 8*a* into the engagement groove 7. When the lock portion 8*a* is fitted in the engagement groove 7, the lock member 8 stretches over the space between the supporting walls 58, 58 and the cover plate 33 and the engagement groove 7 to restrict oscillation of the locked member 20, thus locking tilt of the seat.

In case of unlocking the seat, pushing up the operation portion 38 of the lock operation lever 18 involves the shaft portion 37 to rotate in the counterclockwise direction in FIG. 1 and the head portion 34*b* of the switching lever 34 is moved from the lock groove 35*a* to the unlock groove 35*b* to be held therein. Rotation of the head portion 34*b* gives the impetus to the lock member 8 through the impetus giving spring 43 in the direction for removing the lock member 8 from the engagement groove 7.

Here, if a user is seated and applying his/her weight on the seat, this weight and the reaction force of the reaction force imparting mechanism 28 are balanced to cause no large friction force between the engagement groove 7 and the lock portion 8*a*, and the lock member 8 is removed from the engagement groove 7 to cancel the locked state. The locked member 20 and the seat therefore become capable of rocking.

The reaction force from the reaction force imparting mechanism 28 causes the large friction force between the lock portion 8*a* fitted in the engagement groove 7 and the locked member 20 to maintain the state where the lock member 8 is being put in the engagement groove 7 even when no one is seated and the lock operation lever 18 is set to the unlock mode. This ensures the self-holding state in which the position of the seat is maintained as it is. Therefore, it is possible to prevent the seat and the backrest from suddenly springing up even when no one is seated and the lock operation lever 18 is operated to the unlock side. Further, if a user takes the seat which is in the self-holding state, the weight of the user and the reaction force of the reaction force imparting mechanism 28 are balanced to eliminate the friction force applied to the lock member 8, and the lock member 8 is then removed from the engagement groove 7 (unlock state), thereby enabling oscillation of the locked member 20 as well as the seat.

According to the rocking apparatus 1 of this embodiment, since the seat is supported by the seat bearing member 3 and the reaction force imparting member 6 at three points corresponding to apices of a triangle defined by the two front connecting members 19, 19 of the seat plate 4 and the locked member 20 also serving as a strut, a large bracket which is long in the front-and-back direction is no longer necessary as the seat bearing member 3, reducing restrictions in design associated with the appearance of the chair. In addition, according to this rocking apparatus, since a large bracket is unnecessary, a number of constituent parts can be reduced and some processes such as welding of the bracket can be eliminated, thus simplifying the assembling steps of the chair. This can reduce the cost for manufacturing the chair.

Further, according to the rocking apparatus 1 of this embodiment, since the simple mechanism is used to realize the self-holding function, the self-holding function can be provided without greatly increasing a number of constituent parts as compared with a prior art chair having no self-holding function. As a result, the self-holding function can be obtained while suppressing the complicity of the manufacturing process or the manufacturing cost of the chair to the same level as the prior art chair.

Furthermore, according to the rocking apparatus 1 of this embodiment, the locked member 20 has both the lock function for locking tilt of the seat by fitting the lock member 8 and the rocking function for rocking the seat by being provided between the seat plate 4 and the reaction force imparting member 6 to support the seat. Common use of the member can therefore reduce a number of constituent parts. Although the locked member 20 has both the seat tilt locking function and the seat rocking function in the foregoing embodiment, the present invention is not restricted thereto and the locked member 20 may have only the seat tilt locking function and the seat rocking function may be realized by any other mechanism.

Figure 14:
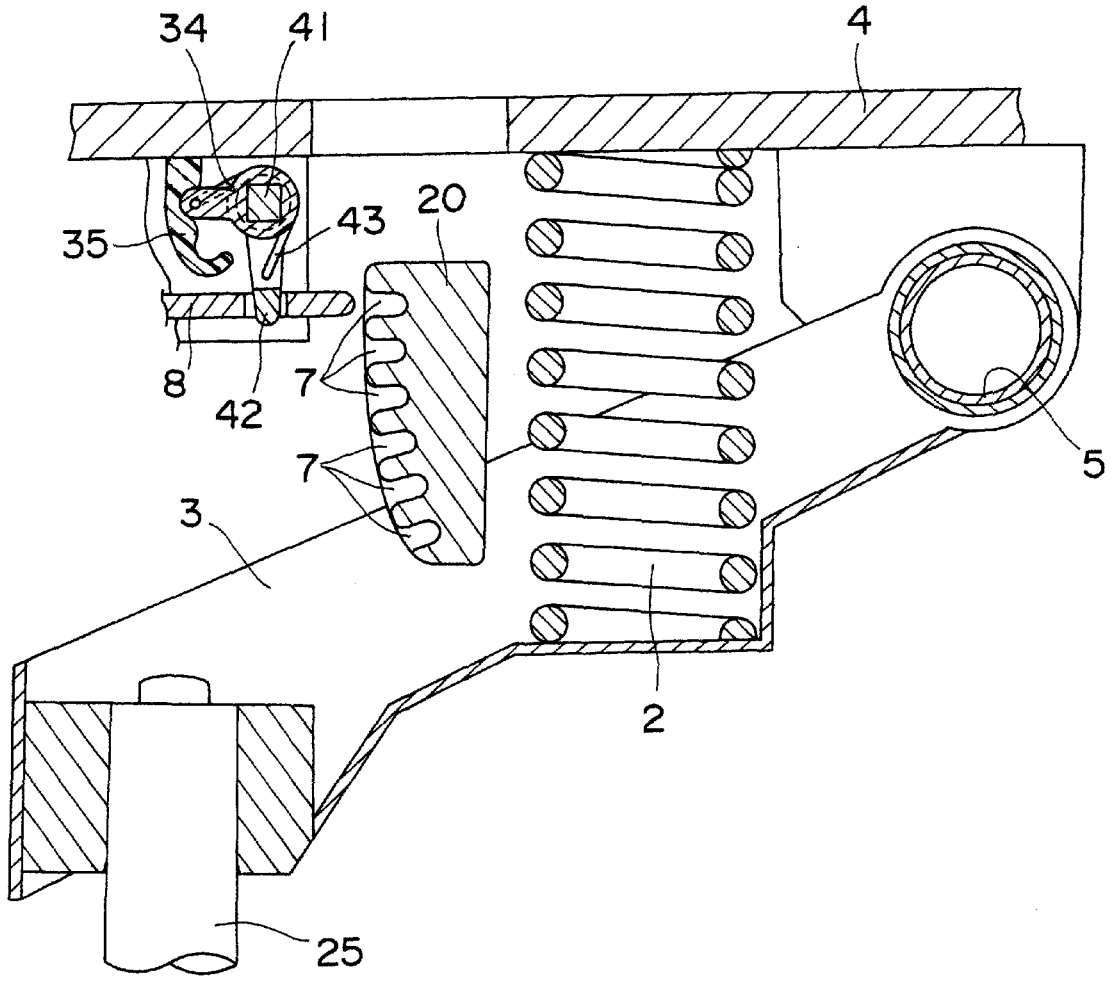
FIG. 14 is a schematic vertical sectional side view showing another embodiment of the rocking apparatus.

It is to be noted that the above is one preferred embodiment but the present invention is not limited thereto and various modifications and other embodiments are possible within the true scope and spirit of the invention. For example, the locked member 20 is fixed to the seat and the three parts, i.e., the lock member 8, the lock operation lever 18 and the impetus giving means 24 are attached to the seat bearing member 3 in the above embodiment, but the invention is not restricted to this structure, and the reaction force imparting mechanism 28 may be directly connected to the seat plate 4, the locked member 20 may be fixed to the seat bearing member 3 while the lock member 8, the lock operation lever 18 and the impetus giving means 24 may be attached to the seat plate 4, as shown in FIG. 14. In this case, the oscillating seat plate 4 moves together with the lock operation lever 18, and the relative position of the seat and the lock operation lever 18 can be thus always fixed irrespective of the inclination angle of the seat. Therefore, when providing the lock operation lever 18 to, e.g., the side portion of the seat where the quantity of relative movement of the seat and the seat bearing member 3 is large, the operability can be further improved than the case in which the lock operation lever 18 is provided to the side portion of the seat bearing member 3.

Moreover, the locked member 20 is fixed to the seat plate 4 and the reaction force imparting member 6 and the lock member 8 is disposed to the seat bearing member 3 so as to be capable of oscillating in the front-and-back direction in the foregoing embodiment, but the present invention is not restricted to this structure and the locked member 20 may not be fixed to the reaction force imparting member 6 but attached to the seat plate 4 so as to be capable of oscillating in the front-and-back direction and the lock member 8 may be fixed to the seat bearing member 3. The lock operation lever 18 and the impetus giving means 24 are provided to the seat plate 4 as in the embodiment shown in FIG. 14 so that the locked member 20 can rock in the front-and-back direction. According to this rocking apparatus 1, the reaction force from the reaction force imparting mechanism 28 can cause the large friction force to be generated between the lock portion 8*a* fitted in the engagement groove 7 and the locked member 20 even through the lock operation lever 18 is set to the unlock position, and the lock member 8 is maintained to be inserted in the engagement groove 7, thereby entering the self-holding state where the position of the seat is kept without any change.

Figure 15:
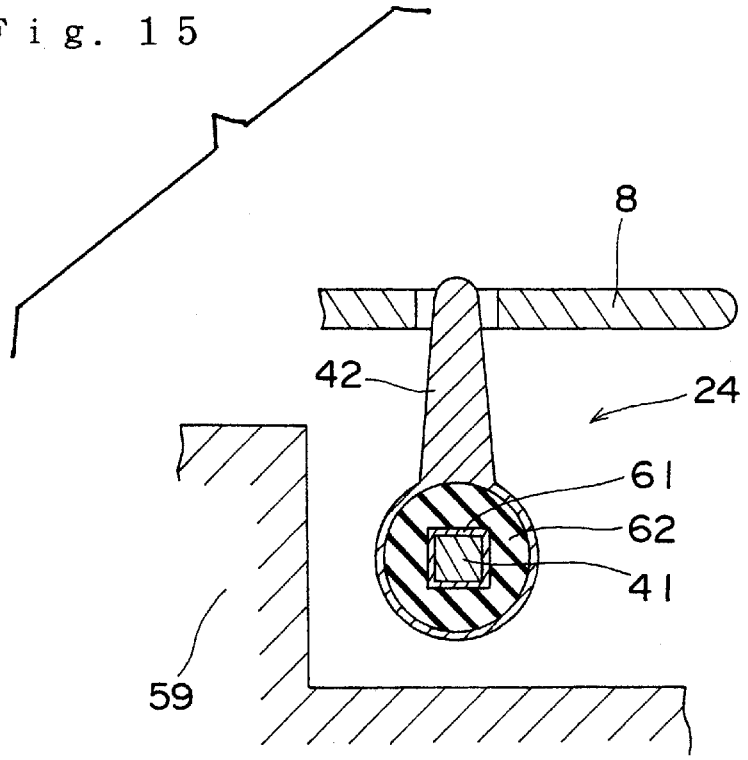
FIG. 15 is a side view showing another embodiment of the impetus giving means.
Figure 16:
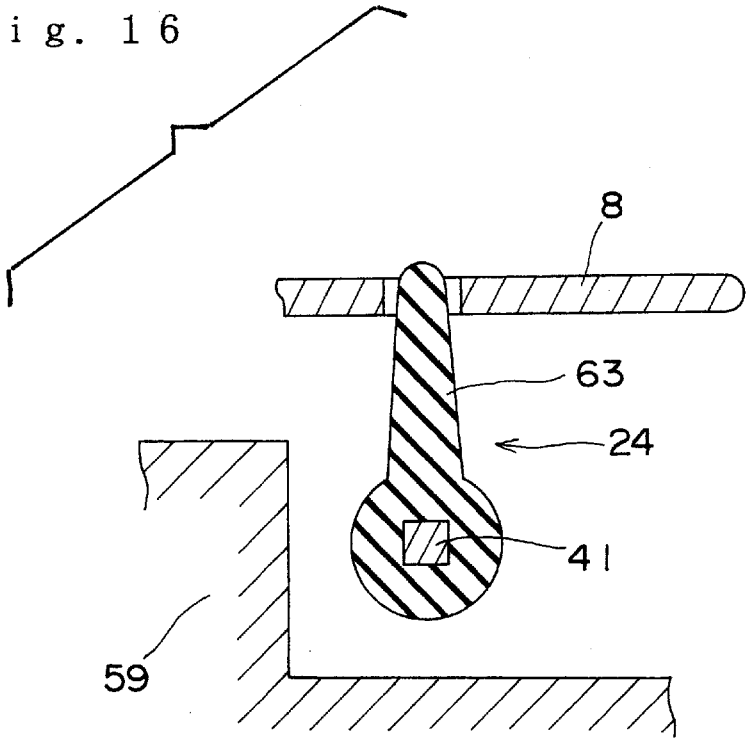
FIG. 16 is a side view showing still another embodiment of the impetus giving means.

In addition, the above embodiment employs the impetus giving spring 43 consisting of a torsion coil spring as an elastic body of the impetus giving means 24, but the present invention is not restricted thereto and elastomer such as rubber may be used. For example, as shown in FIG. 15, the impetus giving means 24 may comprise: a tube-like fitting member 61 fitted to the fitting portion 41 of the shaft portion 37 to integrally rotate therewith; an elastic portion 62 as an elastic body consisting of elastomer such as rubber integrally attached to the circumference of the fitting member 61; a switching arm 42 integrated with the circumference of the elastic portion 62 and engaged with the lock member 8; and a switching lever and a holding member (not shown) similar to those illustrated in FIGS. 1 through 12. In this case, rotation of the lock operation lever 18 can also elastically give an impetus to the lock member 8 in the same direction. In addition, as shown in FIG. 16, the impetus giving means 24 may be made up of an elastic arm 63 which is fitted in the fitting portion 41 of the shaft portion 37 to integrally rotate and engaged with the lock member 8 and which also serves as the elastic body consisting of elastomer such as rubber and the switching arm; and a switching lever and a holding member (not shown) similar to those in the embodiment illustrated in FIGS. 1 through 12. In this case, rotation of the lock operation lever 18 can also give an impetus to the lock member 8 in the same direction.

Figure 17:
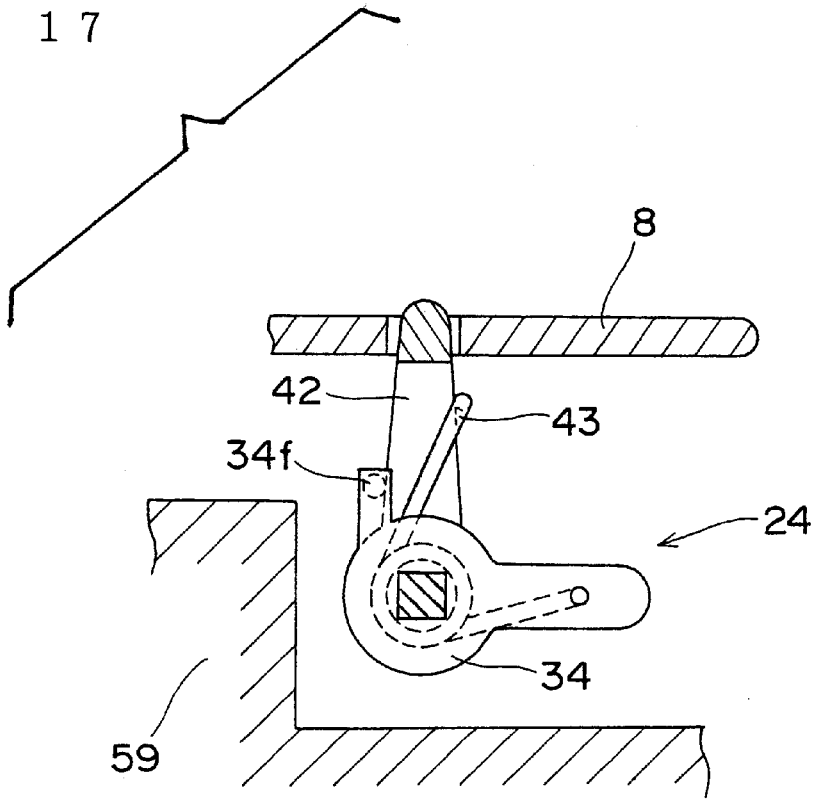
FIG. 17 is a side view showing a further embodiment of the impetus giving means.

Further, rotation of the switching lever 34 can be transmitted to the switching arm 42 through the impetus giving spring 43 by rotating the switching lever 34 in the both directions in the above-described embodiment, but the present invention is not limited to this structure and rotation of the switching lever 34 may be transmitted to the switching arm 42 through the impetus giving spring 43 by rotating the switching lever 34 only in the direction for removing the lock member 8 from the engagement groove 7. For example, as shown in FIG. 17, a projecting portion 34*f* which abuts on the rear surface of the switching arm 42 is formed to the switching lever 34. Further, the end of the impetus giving spring 43 by the side of the switching arm 42 is set to be caught by the front side of the switching arm 42. With this structure, rotation of the switching lever 34 can be transmitted to the switching arm 42 through the impetus giving spring 43 when rotating the switching lever 34 in the direction for removing the lock member 8 from the engagement groove 7, while the projecting portion 34*f* of the switching lever 34 comes into contact with the rear surface of the switching arm 42 to directly push the switching arm 42 toward the front side when rotating the switching lever 34 in the direction for fitting the lock member 8 in the engagement groove 7. In this case, since the seat is self-held when no one is seated and the lock operation lever 18 is turned to the unlock position, the seat and the backrest can be prevented from suddenly springing up.

Although the shaft portions 37 and 49 are coaxial and arranged so that their ends be close to each other in the above-described embodiment, the invention is not restricted to this structure and these shaft portion may be arranged so that the respective ends be close to each other at, e.g., a right angle. This example can also intend reduction in size of the rocking apparatus 1. Moreover, although the seat height operation mechanism 46 is adopted as another mechanism in the foregoing embodiment, the invention is not restricted thereto and a different type of mechanism using any other rotary shaft such as an armrest rocking apparatus may be employed. In this case, the two rotary shafts can be similarly connected by the connecting means 54. In addition, the two claws 55, 55 are provided to the connecting means 54 at two positions to connect the two shaft portions 37 and 49, but the invention is not restricted thereto and the claws 55, 55 may be provided to the connecting means 54 at three or more positions to connect three or more rotary shafts. This can also intend reduction in size of the rocking apparatus 1. Further, the single connecting means 54 connects the two shaft portions 37 and 49 in the above embodiment, but the present invention is not limited to this configuration and different members may be provided in accordance with each of the shaft portions 37 and 49 to prevent the shafts from coming off the seat bearing member 3.

Figure 18:
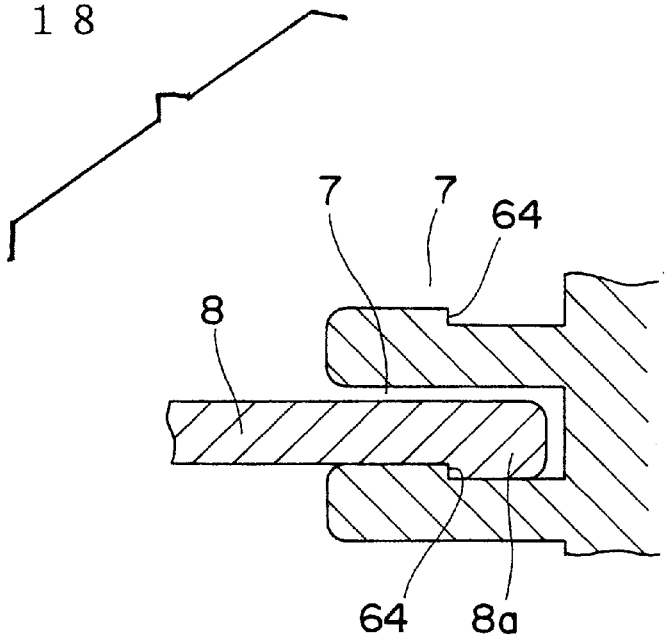
FIG. 18 is a vertical sectional side view showing engagement made between a lock member and an engagement groove.
Figure 19:
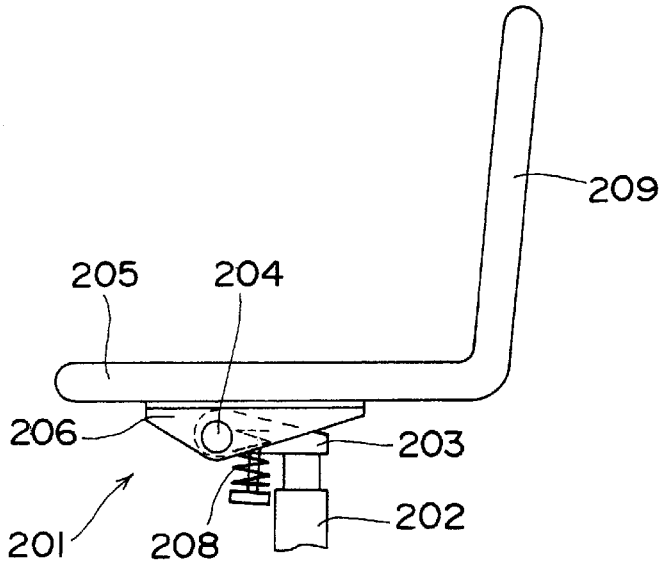
Fig. 19 (RELATED ART)
FIG. 19 is a side view showing a prior art rocking apparatus.
Figure 20:
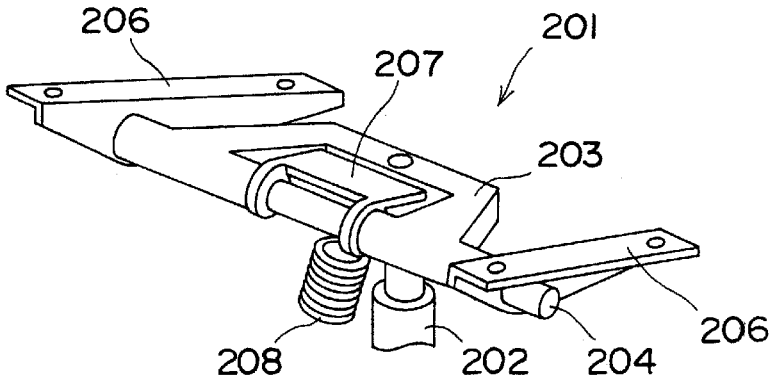
Fig. 20 (RELATED ART)
FIG. 20 is a perspective view showing prior art rocking apparatus.
Figure 21:
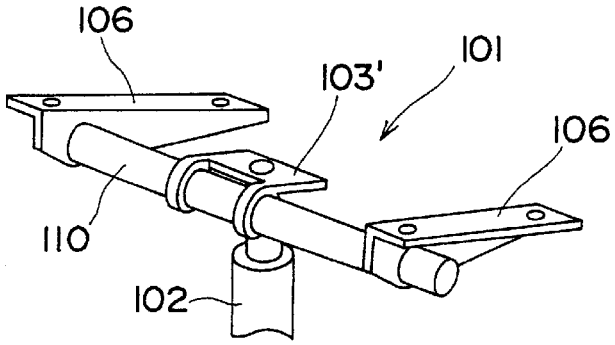
Fig. 21 (RELATED ART)
FIG. 21 is a perspective view showing still another prior art rocking apparatus.
Figure 22:
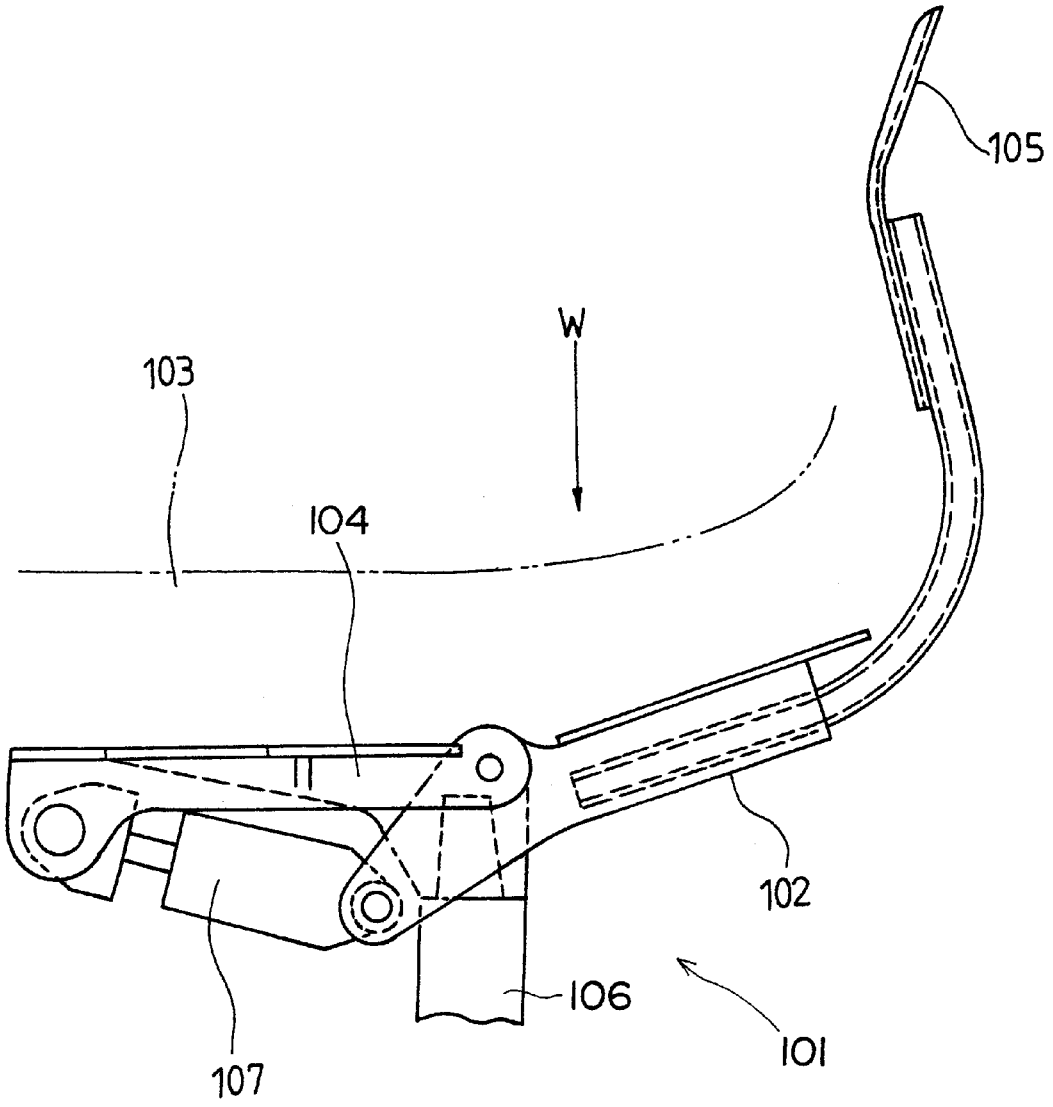
Fig. 22 (RELATED ART)
FIG. 22 is a side view showing another conventional tilting apparatus for a chair.

Furthermore, the surfaces with which the engagement groove 7 and the lock member 8 are brought into contact in the self-holding mode are flat in the above embodiment, but the present invention is not limited to this structure and shoulder portions 64 may be formed on the surfaces with which the engagement groove 7 and the lock member 8 are brought into contact in the self-holding mode so that they can be caught by each other, as shown in FIG. 18. In this case, the load with which the self-holding mode can be cancelled can be easily changed by adjusting the height of the shoulder portions when manufacturing the engagement groove 7 or the lock member 8.

Although the supported member serves as the seat and the supporting member serves as the seat bearing member, respectively, in the above embodiment, the present invention is not restricted thereto and can be applied to all the rocking mechanisms having the supporting member and the supported member constantly receiving an impetus in a direction along which an included angle is widened between the two members, one of these member oscillating around one rotary shaft so that the included angle between these members changes. For example, the supported member may be the backrest or the armrest while the supporting member may be a member for supporting them. In this case, since the backrest or the armrest can be self-held by setting the operation lever to the unlock position when no one is seated, the backrest or the armrest can be prevented from suddenly springing up.

Although the helical compression spring 2 is used as a reaction force source of the reaction force imparting mechanism 28 in the above embodiment, the present invention is not limited thereto and a torsion bar may be used instead. In such a case, when the torsion bar is also used as the supporting shaft 5 to fix the central part of the supporting shaft 5 and the reaction force imparting member 6, rotation of the reaction force imparting member 6 can twist the torsion bar to accumulate the impetus therein. With this arrangement, the degree of freedom in design of the chair can be improved and a number of constituent parts can be reduced.

Moreover, the supporting shaft 5 consists of one rod protruding toward the right and left of the seat bearing member 3 in the above embodiment, but the present invention is not restricted thereto and the supporting shaft 5 may consist of, e.g., two rods divided in the right and left direction. The seat bearing member 3 can similarly support the seat plate 4 and the reaction force imparting member 6 in this example.

On the other hand, the supporting shaft 5 is fixed to the seat bearing member 3 to rotatably attach the reaction force imparting member 6 in the above embodiment, but the present invention is not limited thereto and the supporting shaft 5 itself may be rotatably supported on the seat bearing member 3 and the reaction force imparting member 6 may be fixed to the supporting shaft 5. In this case, if the armrests are provided on both the ends of the supporting shaft 5, the armrests rotates together with the supporting shaft 5 in accordance with the rocking movement of the seat, thereby enabling the rocking movement while maintaining the relation of a position between the seat and the armrests.

Although above has mainly described the examples to which the rocking apparatus according to the present invention is applied to a chair, the present invention is not restricted thereto and can be generally applied to those that support the supported member on the supporting member so as to be capable of tilting and those that oscillate the supported member and the supporting member around the rotary shaft so that the included angle between these members changes. For instance, the present invention can be applied to a table top of a personal computer table, a drafting table top and others which have a large weight. A large reaction force is applied to keep the balance because such a table top has a large weight. In this case, the table plate is self-held by operating the operation lever to the unlock side when no load is applied on the table plate, thereby preventing occurrence of such a phenomenon as that the table plate suddenly springs up.

I claim:

1. A rocking apparatus for supporting a first supported member on a second supporting member in such a manner that the first member can tilt around a rotary shaft with respect to the second member, the rotary shaft being engaged between the first and second members, and a reaction force imparting mechanism engaged between the first and second members for biasing the first member toward an initial base position with respect to the second member, the rocking apparatus comprising: connecting members for connecting the rotary shaft and the first member at two distant points on the rotary shaft and for rotatably supporting the first member on the second member; a reaction force member supported by and rotatable on the rotary shaft, the reaction force imparting mechanism being encased with the reaction force member to bias the reaction force member toward the first member; and a strut between the reaction force member and the first member at a position corresponding to one apex of a triangle, the strut being connected to at least either the reaction force member or the first member in order to support the first member on the reaction force member, a remaining two apices of the triangle being defined by the connecting members at the two distant points on the rotary shaft, thereby supporting the first member on the reaction force member and the rotary shaft by a three-point support using the connecting members and the strut.

2. A rocking apparatus according to claim 1, wherein each connecting member is a bracket having a claw portion for clamping onto the rotary shaft.

3. A rocking apparatus according to claim 1, wherein each connecting member and/or the strut with the first member are made of synthetic resin and are integrally molded.

4. A rocking apparatus according to claim 1, wherein the strut is fixed to the reaction force member.

5. A rocking apparatus according to claim 1, further comprising: a member to be locked having a plurality of engagement grooves aligned in a tilting direction of the first member and attached to either the second member or the first member; a lock member attached to either the first member or the second member respectively, so as to be capable of sliding in a direction for being fitted into or removed from one of the engagement grooves for locking the first member into a selected tilted position when the lock member is fitted in the one engagement groove; an operating means which is switched between a lock position and an unlock position; a position holding means which hold the operating means at least in the unlock position; and drive means between the operating means and the lock member to transmit movement of the operating means to the lock member and to elastically bias the lock member at least in a direction for removing the lock member from the one engagement groove.

6. A rocking apparatus according to claim 5, wherein the position holding means can hold the operating means at both the lock position and the unlock position and the drive means elastically biases the lock member in both the direction for removing the lock member from the engagement groove and the direction for fitting the lock member into the engagement groove.

7. A rocking apparatus according to claim 5 or 6, wherein the drive means comprises: a switching arm engaged with the lock member in the sliding direction of the lock member; a switching lever associated with the operating means to be switched between and held at the lock position and the unlock position; an elastic body provided between the switching lever and the switching arm; and a holding member for holding the switching lever at the lock position and the unlock position.

8. A rocking apparatus according to claim 5, further comprising: a first rotary shaft for rotating integrally with the operating means; a second rotary shaft coaxially arranged with the first rotary shaft with their ends being close to each other; an arm for rotating integrally with the second rotary shaft and being rotatably supported by the first rotary shaft; and a connecting means for rotatably connecting the ends of these rotary shafts.

9. A rocking apparatus according to claim 5, wherein the member to be locked comprises the strut.

10. A rocking apparatus according to claim 1 or 5, wherein the rocking apparatus inclines a seat of a chair, the first member is being a part of the seat, and the second member being a seat bearing member supported on a leg.

11. A rocking apparatus for supporting a first supported member on a second supporting member in such a manner that the first member can tilt around a rotary shaft with respect to the second member, the rotary shaft being engaged between the first and second members, and a reaction force imparting mechanism engaged between the first and second members for biasing the first member toward an initial base position with respect to the second member, the rocking apparatus comprising: a member to be locked having a plurality of engagement grooves aligned in a tilting direction of the first member and attached to either the second member or the first member; a lock member attached to either the first member or the second member respectively, so as to be capable of sliding in a direction for being fitted into or removed from one of the engagement grooves for locking the first member into a selected tilted position when the lock member is fitted in the one engagement groove; an operating means which is switched between a lock position and an unlock position; a position holding means which hold the operating means at least in the unlock position; and drive means between the operating means and the lock member to transmit movement of the operating means to the lock member and to elastically bias the lock member at least in a direction for removing the lock member from the one engagement groove.

12. A rocking apparatus according to claim 11, wherein the position holding means can hold the operating means at both the lock position and the unlock position and the drive means elastically biases the lock member in both the direction for removing the lock member from the engagement groove and the direction for fitting the lock member into the engagement groove.

13. A rocking apparatus according to claim 11 or 12, wherein the drive means comprises: a switching arm engaged with the lock member in the sliding direction of the lock member; a switching lever associated with the operating means to be switched between and held at the lock position and the unlock position; an elastic body provided between the switching lever and the switching arm; and a holding member for holding the switching lever at the lock position and the unlock position.

14. A rocking apparatus according to claim 11, further comprising: a first rotary shaft for rotating integrally with the operating means; a second rotary shaft coaxially arranged with the first rotary shaft with their ends being close to each other; an arm for rotating integrally with the second rotary shaft and being rotatably supported by the first rotary shaft; and a connecting means for rotatably connecting the ends of these rotary shafts.

* * * * *